US006293689B1

(12) United States Patent
Guntert, Jr. et al.

(10) Patent No.: US 6,293,689 B1
(45) Date of Patent: Sep. 25, 2001

(54) HIGH VOLUME PORTABLE CONCRETE BATCHING AND MIXING PLANT HAVING COMPULSORY MIXER WITH OVERLYING SUPPORTED SILO

(75) Inventors: Ronald M. Guntert, Jr., Stockton, CA (US); William R. Cape; Christopher Cape, both of Racine, WI (US); Roberto Salgarollo, Herentals (BE); Lowell B. Campbell, Oakdale, CA (US)

(73) Assignee: Guntert & Zimmerman Const. Div., Inc., Ripon, CA (US)

( * ) Notice: Subject to any disclaimer, the term of this patent is extended or adjusted under 35 U.S.C. 154(b) by 0 days.

(21) Appl. No.: 09/665,891

(22) Filed: Sep. 20, 2000

(51) Int. Cl.[7] ..... B28C 7/00
(52) U.S. Cl. ..... 366/2; 366/41
(58) Field of Search ..... 366/2, 1, 6, 10, 366/16–19, 14–15, 26, 27, 28, 30, 33, 41–45, 53–54, 60, 62, 63; 414/683, 919

(56) References Cited

U.S. PATENT DOCUMENTS

| | | | | |
|---|---|---|---|---|
| 3,050,259 | * | 8/1962 | Paulus et al. | 366/9 |
| 3,064,832 | | 11/1962 | Heltzel | 414/332 |
| 3,151,849 | | 10/1964 | Maxon, Jr. | 366/41 |

(List continued on next page.)

OTHER PUBLICATIONS

RexCon Concrete Batch Plants and Controls, "Model S Batch Plant," www.rexcon.com/products/english/ebatch/e/models.html., Apr. 9, 1999, 2 pgs description, 2 pgs. pictures.

Erie Strayer Co., MG–11C Central Mix Batching Plants, "Mobile Gravity 11 Central Mix," Bulletin No. MG11C89, Feb. 1989.

Erie Strayer Co., Sentry/Scout Batching Control System, "Fast, Accurate, Reliable Batching Control Systems." Bulletin No. CP, Mar. 1999.

Erie Strayer Co., "Mobile Gravity and Central Mix Plant," Drawing No. 4A–219801, Jan. 7, 1991.

Erie Strayer Co., "Mobile Gravity, Central Mix Plant with Conc. Directional Chute," Drawing No. 4A–219802, Jan. 7, 1991.

Vince Hagan Co., "Super Haganator, 'Mobile Paver' Central Mix Concrete Plant System (2 to 12 cubic yards)," Bulletin 109, Nov. 15, 1977.

Vince Hagan Co., "10 Yard Central Mix Plant," Drawing No. S228, Apr. 20, 1982.

Heltzel Steel Form & Iron Co., Self–Erect Mobile Central–Mix Batching Plants and Mobile Mixers, Bulletin No. 66–70R, No date.

Johnson–Ross concrete Plants, "Ranger 750," Bulletin No. 50–098, No date.

*Primary Examiner*—Tony G. Soohoo
(74) *Attorney, Agent, or Firm*—Townsend and Townsend and Crew LLP

(57) ABSTRACT

A four trailer portable concrete batching and mixing plant has production volumes of up to 600 cubic yards of concrete per hour of paving concrete meeting exacting modem paving standards. A first mixer trailer with a mounted water tank forms the plant frame foundation at a twelve-yard compulsory mixer. A second silo trailer having 900 barrel capacity has cantilever support from a steered towing wheel set at the bottom of the silo. The silo trailer is backed at the steered towing wheel set to the side of the compulsory mixer trailer and pinned at its cantilevered connection for pivotal erection. Once pinned to the side of the compulsory mixer trailer, a silo trailer contained jacking system self erects the silo utilizing the compulsory mixer and trailer as a foundation. With the silo erected, a third aggregate trailer occupies the footprint vacated by the erected silo. Fourth, a control trailer having a control booth, power plant and liquid admixture storage is adjustably positioned on the site to complete the plant.

19 Claims, 19 Drawing Sheets

U.S. PATENT DOCUMENTS

| | | | | |
|---|---|---|---|---|
| 3,820,762 | * | 6/1974 | Bostrom et al. | 366/18 |
| 3,891,193 | | 6/1975 | Perry, Jr. | 366/31 |
| 3,938,673 | | 2/1976 | Perry, Jr. | 366/18 |
| 3,945,619 | | 3/1976 | Taibi | 366/18 |
| 3,998,436 | * | 12/1976 | Allen et al. | 366/18 |
| 4,178,117 | | 12/1979 | Brugler | 414/21 |
| 4,457,660 | | 7/1984 | Pippinger | 414/332 |
| 4,493,584 | | 1/1985 | Guntert, Sr. . | |
| 4,494,903 | | 1/1985 | Badicel et al. . | |
| 4,548,538 | | 10/1985 | Brüder et al. | 414/332 |
| 4,579,496 | | 4/1986 | Gerlach | 414/332 |
| 4,580,902 | | 4/1986 | Dunstan | 366/33 |
| 4,775,275 | | 10/1988 | Perry | 366/18 |
| 4,792,234 | | 12/1988 | Doherty | 366/18 |
| 4,943,200 | | 7/1990 | Edwards et al. | 414/332 |
| 4,944,646 | | 7/1990 | Edwards et al. | 414/332 |
| 4,956,821 | * | 9/1990 | Fenelon | 366/41 |
| 5,121,989 | * | 6/1992 | Horton et al. | 366/30 |
| 5,135,333 | | 8/1992 | Guntert, Sr. . | |
| 5,590,977 | | 1/1997 | Guntert, Jr. . | |
| 5,615,972 | | 4/1997 | Guntert, Jr. . | |
| 5,667,298 | * | 9/1997 | Musil et al. | 366/17 |
| 5,695,280 | * | 12/1997 | Baker et al. | 366/41 |
| 5,730,523 | | 3/1998 | Flood | 366/18 |
| 5,785,421 | * | 7/1998 | Milek | 366/41 |
| 6,186,654 | * | 2/2001 | Gunteret, Jr. et al. | 366/27 |

* cited by examiner

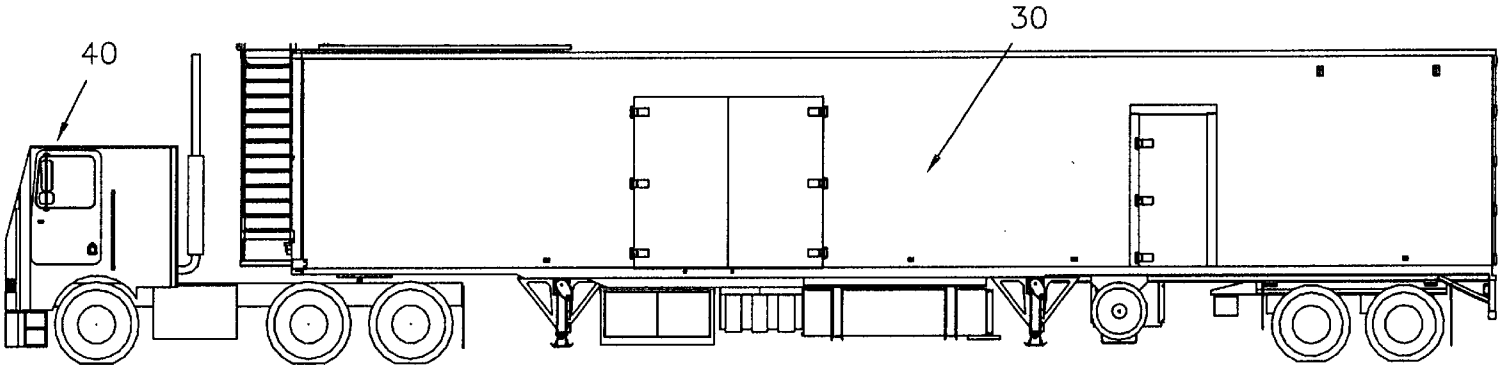
FIGURE 4A TRANSPORT CONFIGURATION
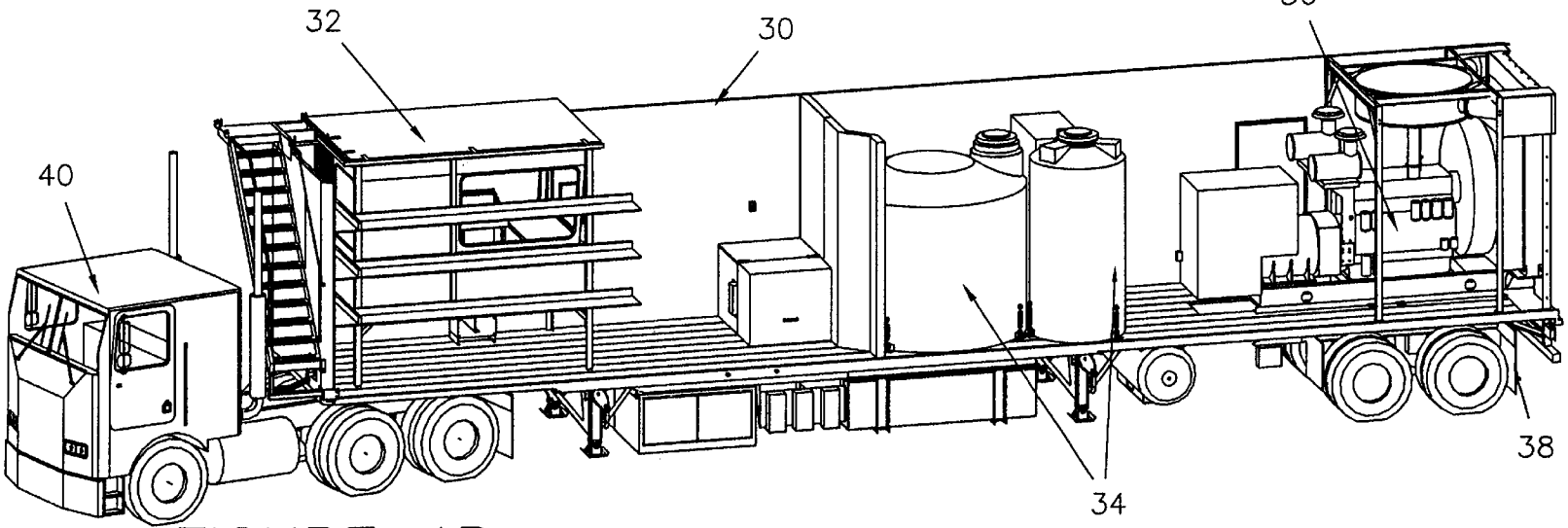
FIGURE 4B TRAILER CONTENT SHOWN

HIGH VOLUME PORTABLE CONCRETE BATCHING AND MIXING PLANT HAVING COMPULSORY MIXER WITH OVERLYING SUPPORTED SILO

This invention relates to portable, batching and mixing concrete plants having a compulsory mixer. More particularly, a four trailer portable concrete plant is disclosed having a mixer trailer, silo trailer, aggregate trailer, and control trailer. The mixer trailer forms at its mounted compulsory mixer a foundation on which the trailer-transported silo is erected. An aggregate trailer mates to the assembled mixer and silo trailers to supply aggregate. These three assembled trailers when combined to a control trailer form a mobile batching and mixing plant of high capacity, which can be erected on site in a day without semi-permanent foundations, without the need of a crane and controlled in operation and powered from the control trailer.

CROSS-REFERENCES TO RELATED APPLICATIONS

This application covers similar subject matter as set forth in U.S. patent application Ser. No. 09/255,745 entitled High Capacity, Highly Mobile Concrete Batching and Mixing Plant Design by Guntert et al (the same group of inventors as set forth herein) filed Feb. 23, 1999. For purposes of this disclosure, the entire contents of the above entitled patent application is incorporated by references as if fully set forth herein.

BACKGROUND OF THE INVENTION

In the above referenced disclosure—which at the time of the filing of this application was a pending U.S. Patent Application—we set forth the extant background and related art. The design in the former application illustrated a two trailer portable plant having a maximum capability in the range of 300 cubic yards of concrete per hour. Subsequent development and design by us has indicated that a plant of twice that size may well be required. As no such high quantity mobile concrete plants have yet been operated or disclosed, we therefore repeat the background of the invention as originally set forth in that invention.

In the discussion that follows, the prior art is set forth in terms of the need for this invention. It is to be understood that we claim invention both in the recognition of that need as well as the solution that follows.

Modern concrete paving practices impose more severe constraints on concrete quality every year. Specifically, concrete when freshly mixed is tested and measured for different desired qualities and standards pursuant to imposed and specified quality control standards. These standards include moisture content (or slump), both compressive and flexural strength after a prescribed number of days, aggregate shape, air content, and uniformity, to name a few. If the quality standards of the concrete produced vary statistically above or below the prescribed standard mean, then the concrete producer is penalized financially.

Exemplary of these standards would be concrete compressive strength where the concrete strength is to reach say 3,500 psi in 28 days. The specification might allow a variation of this standard of 5% above or below this mean or the contractor would be penalized.

It is generally agreed that higher strength concrete can be reached in a shorter period of time by better mixing action and lower water/cement (W/C) ratios. Thus the lower the concrete slump, the easier it is for the contractor to reach the specified strengths. The trend in the industry is toward lower W/C ratios. Low W/C ratio concrete mixed in conventional tilting drum mixers do not reach uniformity as quickly as the mixer used in this invention.

The cost of the concrete makes up the majority of the cost of the road or airport pavement being built. Given the large volumes of concrete processed in such paving contracts, supervisory and specifying authorities such as state and federal inspectors can only statistically sample the loads of concrete to determine the quality of the concrete delivered by the contractor. Because of the large quantity of concrete that can be produced by the contractor in a day, the contractor faces great financial risk if many days pass before he realizes the concrete he is producing is testing outside of specification mean. The above example is intended to show how important it is for the contractor to maintain quality control on the concrete be produces. It is imperative that the contractor use batching and mixing equipment capable of delivering uniformly mixed concrete of the low slump variety to precision construction specifications without increasing the mixing time required to reach uniformity. If it takes longer mixing times to reach uniformity, the number of concrete batches per hour that plant can produce decreases. This results in the contractors cost to place the concrete increasing because his fixed paving costs per hour are divided by fewer yards of concrete.

Modern concrete paving practices also call for the use of slipform pavers, which in operation consume relatively large amounts of concrete. On a typical urban size paving job, where the total cubic yards of concrete to be used on the job is relatively small, a modern paver can consume concrete in the range of 240 to 300 cubic yards per hour. On larger jobs the contractor may choose to mobilize, produce and deliver concrete to the slipform paver at a higher rate with a larger plant with higher capacity. Exemplary of such a paver is that Slipform Paver sold under the designation of model S850 built by Guntert & Zimmerman of Ripon, Calif. The fundamental design of this model was pioneered by the late Ronald M. Guntert, Sr. of Stockton, Calif. as set forth in U.S. Pat. Nos. 4,493,584 and 5,135,333.

Other more recent examples of pavers consuming high volumes of concrete can be found in U.S. Pat. No. 5,590,977 entitled Four Track Paving Machine and Process of Transport by Ronald M. Guntert (herein) et al. And U.S. Pat. No. 5,615,972 entitled Paving Machine with Extended Telescoping Members by Ronald M. Guntert (herein).

As cement in the concrete starts to hydrate during transport to a paving site, portable concrete batching and mixing plants have been developed for mixing concrete adjacent the paving site. This reduces the hauling distance to where the concrete is being used and to reduce the number of concrete hauling units required. Simply stated, from a plant, which mixes concrete to the site where such mixed concrete is placed, most contract specifications set a time limit of 30 minutes for non-agitating trucks, which is about a 12 mile transport limit. This practical transport limit is reduced in high traffic areas or other situations where the average speed at which the hauling unit can travel is reduced. If the time limit is exceeded, the concrete that is hauled will start to set before the paver places it and the paver placed concrete will not meet the required contract standards.

Secondly, and given the high quality constraints placed on the paved and/or placed concrete product, so-called continuous mixing concrete plants have proven inadequate. Such plants are capable of delivering large volumes of concrete but do so on a continuous flow basis. The exacting standards of thorough mixing covered by precise constituent proportion make the continuous flow adjustment of such plants hazardous from the quality control standpoint. As a result, such continuous mixing concrete plants have not been accepted in modem paving practice, at least in the North American paving market. It is only the processing of specific "batch" quantities of cement, water and aggregates that constitute concrete that enables the relatively high quality requirements to be maintained and conventional calibration and quality assurance measures to be used.

Prior art portable modern batching and mixing concrete plants are large, require concrete foundations and are difficult to erect, often consuming three to five days in assembly. Frequently, these plants require special rigging equipment, such as cranes to accomplish erection. Specifically, it is not uncommon for such plants to occupy 7 or more (sometimes as many as 11) transporting trailers. Further, such plants utilize rotating and tilting drum mixers located high overhead so they can tilt and gravity feed the mixed concrete into the hauling units. The mixer itself is belt fed with aggregates that are gravity fed through batching/weighing hoppers to maintain precise concrete constituent proportions. This produces several undesirable features, which complicate the erection and subsequent operation of such plants:

First the feeding belt is usually gravity fed from overlying storage bins and weighing/batching hoppers. Thus, considerable weight must be supported at substantial heights from the ground on such portable plants. Using weighing belts instead of weighing hoppers is novel in the U.S. for mixing concrete. It is quite common in the asphalt mixing plant industry. In order to load the overlying storage bins that cannot be reached directly by a front-end loader, separate charging conveyors with charging bins are used for each aggregate and sand. The charging bins are at an elevation that can be reached by a front-end loader. Because of the requirement of these charging conveyors and bins, the plant site required is quite large limiting the number of places the plant may be set up.

Second, such rotating mixing drums must be tilted, and in a few cases, reversed in rotation for discharge. This tilting of the drum superimposes a moment requirement upon the weight support requirement of the rotating drum. As a result of the weight and moment requirements, most so-called portable concrete batching and mixing plants require concrete foundations. Further, in a few cases, reversing the mixing drum rotation not only interrupts mixing, but also consumes momentum, and utilizes heavy reversible drives.

Third, because the rotating mixer drums are supported high in the air, if the more desirable gravity feed of cement is used with the rotating mixer drum, the cement silo must be elevated even higher in the air. The resulting silo and structure requires concrete foundations. To save height, and in lieu of gravity feed from the silo to the cement batcher, many manufacturers of conventional concrete plants use cement screws or air slides to convey the cement into the mixer. Most contractors agree these cement-conveying schemes are undesirable although many times tolerated to minimize the silo height. The principle disadvantage of such schemes is that aeration of the cement impedes accurate fast measurement of the concrete.

Fourth, because tilting drum mixers are open in front for discharge and open in the back for loading the concrete constituents into the mixer, it is very difficult to suppress the dust that results from the ingredient loading operation. The inability to adequately suppress the dust coming out of the mixers limits the use of the plant in many urban settings.

Fifth, because the tilting/rotating drum mixer rotates on rollers, can be driven by chain drives or gearbox driving gear on drum. The mixer drum is essentially open during the mixing process. As a result, these conventional mixers are very noisy which limits the use of this plant in many urban settings because of the high decibel readings produced.

Sixth, conventional batching and mixing plants are highly specialized. A contractor will own one plant for his jobs requiring concrete production of 200 to 300 cubic yards per hour and another complete plant when his concrete production needs are 400 to 500 cubic yards per hour. Generally, the larger the plant production capacity per hour the more cumbersome and costly the plant is to transport, set-up and tear down. Moreover, most larger plants that approach the capacity of this invention require two mixer drums. This requirement further makes these plant even more cumbersome and costly to transport, set-up, tear down and maintain.

Finally, rotating/tilting drum mixers are relatively slow in delivering desired amounts of thoroughly and uniformly mixed low slump concrete, base courses and soil cement. Rotating/tilting drum mixer has paddles affixed to the rotating drum wall. Rotating/tilting drum mixers mix by concrete being lifted to the top of the drum and dump it on the concrete below. The limitation of this design is that dry material bridges in the mixer and does not discharge out of the drum readily. Moreover, when cement substitutes are used such as slags, the concrete tends to be sticky which again impedes rapid discharge. With low slump concrete or soil cement, this problem is amplified. As compared to contemporary twin shaft, compulsory mixers now utilized in Europe, longer mixing cycles are generally required for the same material in rotating/tilting drum mixers. With low slump or difficult mix designs, rotating/tilting drum mixers produce less than thorough mixing with resultant "ribbons" of less than homogeneously mixed concrete when compared to a compulsory mixer. As a result, considerable additional mixing time or "dwell time" of the concrete in the rotating/tilting drum mixer is required resulting in fewer loads of concrete being produced in an hour.

It should be understood that so-called compulsory mixers are now in use in Europe and in limited use in North America for mixing soil cement and high performance concrete for the precast concrete pipe and bridge beam industry. These mixers include a top loading, parallel rotating shafts with interval and paired counter-rotating paddles, and a bottom discharge feature. In the past, such compulsory mixers have been used in the European market where the total transport envelope allowed is small when compared to North America. Furthermore, the production rates required in Europe are much lower because of philosophy and logistical requirements thus the size of these compulsory mixers is much smaller. Typically, the largest compulsory mixer used in Europe is 4,5 (6 cyd) m3 and occasionally 6 m3 (8 cyd). As a consequence, such compulsory mixers have not been adapted to high volume portable concrete batching and mixing plants used in North America. The North American market demands that concrete be batched to match the load that the largest available hauling truck can handle. In the case of off road hauling, loads of up to 12 and even 13 cyd can be hauled by a single truck. This invention utilizes either a 10, 12 or 13 cyd compulsory mixer so production time is not lost in double batching. A plant of the dimensions of this invention would not have been conceived for the European market (or other markets which have adopted European transport standards) because the production rates required in Europe are much lower again because of philosophy and logistical requirements. It should also be noted that the majority of the compulsory mixers used in North America today are foreign made and all have mixing capacities of less than 6 cyd.

In understanding the background of this invention, attention should be directed to the practical consequences of having long erection times for portable concrete batching and mixing plants. First, modem slipform pavers can be moved to a new paving site and set-up within one working day (when short transport distances are involved, transport and set-up of the slipform in a day is feasible). Second, current "portable" concrete batching and mixing plants of the same or similar capacity require between three and five days for an equivalent move with 300 to 400 man hours being devoted to each set-up and tear down. The practical result of the time differential between the movement of the slipform paver and the movement of the current so-called portable batching and mixing plant is interesting to understand.

Taking the case of roadway paving of a four lane divided highway, both directions of traffic are diverted to one side of the highway while concrete placement, paving and curing occurs on the opposite side of the highway. Traffic must be maintained while rehabilitating the concrete road. Curing of newly placed concrete on a highway occupies up to 28 days before traffic is allowed on the highway. There is a considerable interval of time where the nearby batching and mixing plant—required to be nearby to reduce the transport interval—will normally remain idle given the total time interval for plant moving. Moving requires 3 to 5 days to set up and 3 to 5 days to dismantle. Thus the decision is frequently made to leave an erected plant idle and in place for paving the opposite side of a highway because it is too costly to move the plant. Considered from the standpoint of the contractor, the operating hours of a current portable batch plant are about half the operating hours of modern slipform pavers. Stated in other terms, the contractor must either own an additional batching and mixing plant or lose the opportunity to use the slipform paver in performing other work. Given modem capital requirements (including about $850,000 for a "portable" batch plant and $650,000 for a modern slipform paver), neither alternative is desirable.

Finally, there must be considered the dimension of the North American road transport envelope used in Canada, USA, Mexico, and Australia. Maximally, transported loads over high quality highways are normally limited to trailer vehicles having less than 85 feet length overall, 13 feet 6 inches in height (many states today allow 14'), and under 12 feet in width. It will thus be immediately understood that in producing a high capacity batch plant, the size of the transport envelope works against the design. While relative size is not normally a consideration in determining invention, in what follows transport envelope size is a critical design factor in the design of the two trailer transportable, high capacity concrete batching and mixing plant of this invention.

Plant footprint has been added as an important factor. Specifically, sites for portable concrete plants can be limited. As will be seen in the disclosure that follows, by utilizing a compulsory mixer and a foundation for an overlying silo, a small plant footprint is maintained.

We again stress that the identification of the above parameters is claimed as invention in so far as they are not collectively set forth in the prior art. It goes without saying that understanding of the problem to be solved can constitute invention, as well as the solution to the problem once it is understood.

SUMMARY OF THE INVENTION

A four trailer portable concrete plant has production volumes of up to 600 cubic yards of concrete per hour of concrete meeting exacting modem paving standards. A first mixer trailer with a mounted water tank forms the plant frame foundation at a twelve-yard compulsory mixer. This same trailer includes a concrete elevating conveyor to receive concrete discharged from the mixer and elevating it to a height to discharge in a truck. A second silo trailer having over 900 barrel capacity has cantilever support from a steered wheel set at the (back) bottom of the silo. The silo trailer is backed up using the steered wheel set into the side of the compulsory mixer trailer and pinned at its cantilevered connection for pivotal erection. Once pinned to the side of the compulsory mixer trailer, a silo trailer contained hydraulic jacking system self erects the silo utilizing the compulsory mixer and mixer trailer as a foundation. Prior to the silo being erected, a third aggregate trailer backs into the mixer trailer at the location of the mixer, on the side opposite where the silo was elevated from. The aggregate trailer is positioned at a distance away from the mixer trailer so the aggregate elevating conveyor can be lowered into the mixer dust hood (part of the silo) in a position to discharge into the mixer. Fourth, a control trailer having the operator controls, power and liquid admixture storage is adjustably positioned on the site to complete the plant. In operation, the silo is conventionally pneumatically filled with cement (50%), fly ash (25%), and slag (25%) with a total capacity of over 900 barrels. The silo of this size permits gravitational settling of its pneumatically conveyed constituents and maintains a fully settled 200 barrel volume for convenient and reliable gravitational measured feed to paired underlying weigh hoppers. Once the prescribed amount of cementatious materials are batched in the weigh hoppers the contents are then discharged into the compulsory mixer. Aggregate and sand is weighed and conveyed from the aggregate trailer in discrete 12-yard (more or less) batches of concrete in the compulsory mixer. Once the compulsory mixer uniformly mixes the concrete the contents bottom dumps to an elevating conveyer where off loading of mixed concrete to receiving trucks can conveniently occur.

The silo contains a complete dust collection system for the entire plant including dust created from the pneumatically conveyed cement and cement substitutes, dust created by conveyance from the silo to the weigh hoppers and finally dust created in the compulsory mixer mixing operation.

BRIEF DESCRIPTION OF THE DRAWINGS

FIG. 4A and 4B illustrates respectively the control, power and admixture trailer under transport as well as a cut-a-way view of the trailer contents;

FIGS. 5A–5F illustrate plant erection with:

FIG. 5A showing the mixer trailer in place and the aggregate trailer elevating belt in position with the silo trailer being backed and positioned at its steering rear wheel set toward a pinned position to the side of the compulsory mixer;

FIG. 5B showing silo trailer pinned to the side of the compulsory mixer trailer with the lifting cylinders and jacking pad moved to a levered position from which pivotal erection of the silo can occur;

FIG. 5C illustrates the silo at top dead center on its pivot with respect to the compulsory mixer and being received by the mixer mounted damping cylinders for gradual lowering of the silo to the firm support of the compulsory mixer;

FIG. 5D illustrates the erected silo overlying the compulsory mixer;

FIG. 5E illustrates the silo jacking pad partially retracted on its pivot from the silo trailer towing wheel set with the jacking pad being withdrawn to the silo overlying the compulsory mixer;

FIG. 5F illustrates the aggregate trailer elevating conveyor in position at the aggregate port of the compulsory mixer with reference being made to FIG. 1 to view the final erected disposition of the plant;

FIGS. 6A–6D show a perspective view of the cement silo alone with

FIG. 6A is a perspective view of the silo alone illustrating the cantilever supports, the paired weigh hoppers, the bottom silo discharge, and the elevated dust collection systems;

FIG. 6B is a side elevation of FIG. 6A illustrating the pair weigh hoppers utilized respectively for cement and cement substitute high volume weight batching;

FIG. 6C is a front elevation of FIG. 6A illustrating paired butterfly and silo "pant leg" discharges to a single weigh hopper discharging between spray bars for the introduction of water to the concrete batch in the compulsory mixer with the dust collection system at the top of the silo forming the fifth wheel connection platform; and, FIG. 6D is a detail at the bottom of the silo illustrating one weigh hopper in place with a dust filters attached and the remaining weigh hopper moved outward so that cement entrance ports can be seen and the point of dust filter attachment understood;

DESCRIPTION OF THE SPECIFIC EMBODIMENTS

Figure 1A:
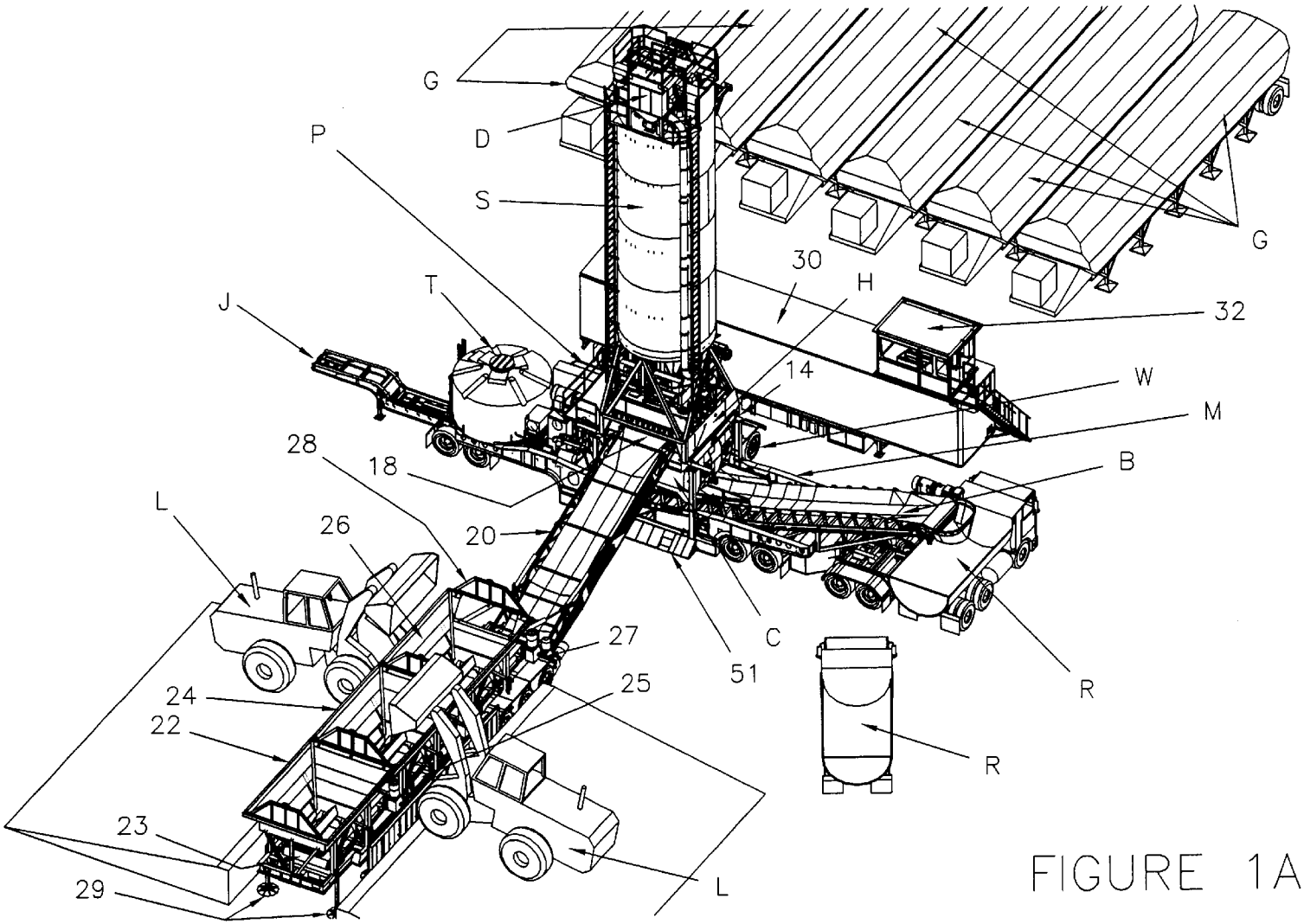
FIG. 1A is a perspective view of an erected and operating portable concrete batch plant in accordance with this disclosure illustrating the silo erected overlying the compulsory mixer with a connected aggregate batching attended by loaders with nearby control trailer with control, power, and admixture supply with six cement storage guppies pneumatically off loading cement and cement substitutes schematically shown.

Referring to FIG. 1A, a perspective view of an assembled concrete plant P is shown. Centrally of FIG. 1A is mixer trailer M having water tank T, compulsory mixer C, and mixed concrete elevating belt B. Two twelve-yard dump trucks R are shown ready for sequential loading. This compulsory mixer may be able to handle and uniformly mix batches of up to 13 cyds. Of course batches smaller than 12 cyds can be batched and mixed at any time.

Figure 1B:
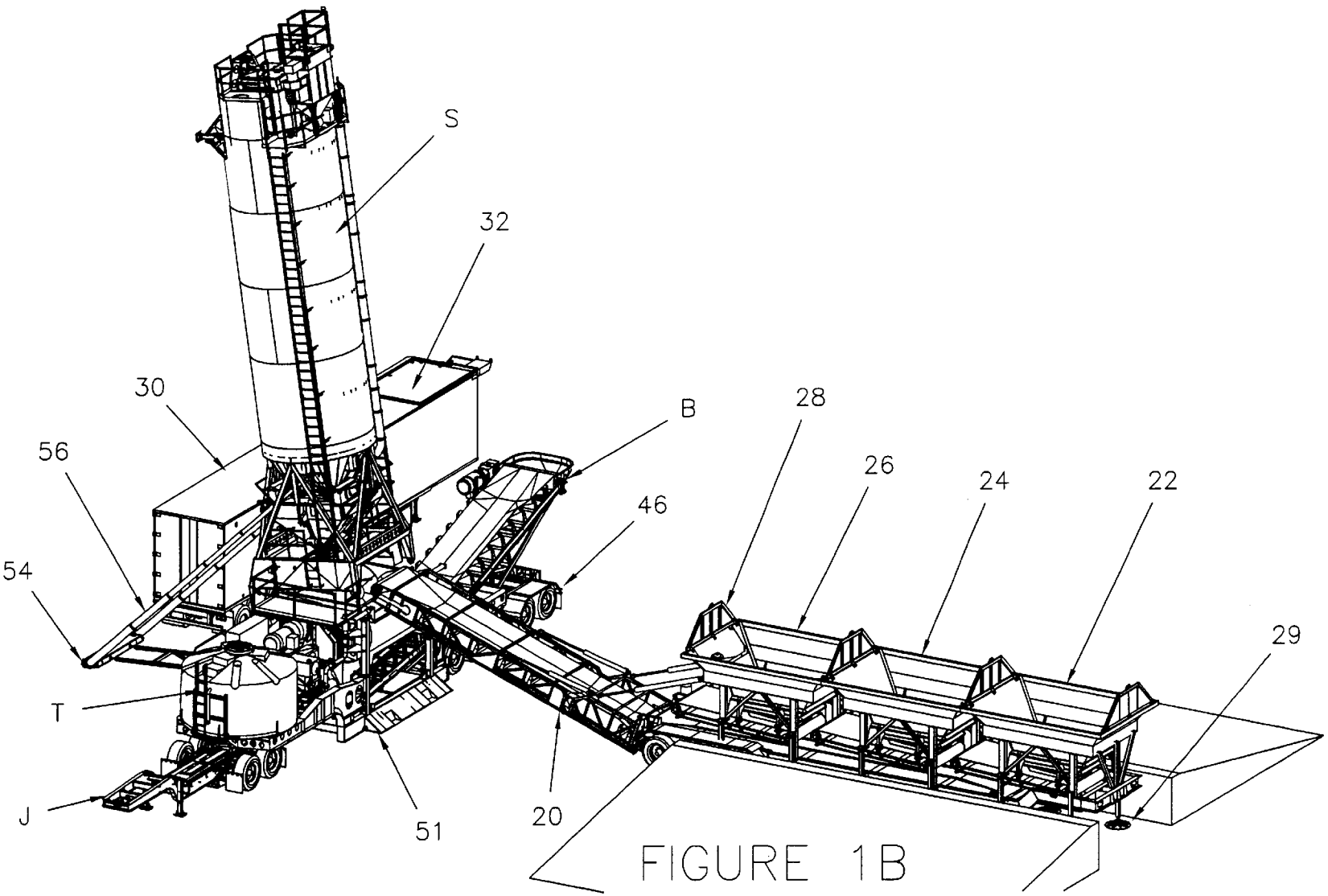
FIG. 1B is a perspective view of the aggregate trailer and mixer trailer in position in accordance with this disclosure illustrating the silo trailer being errected and moving to the top dead center position.

Silo trailer S is shown connected at cantilever beams 14 to rear steered silo trailer wheel set W. As can be observed in FIG. 1B, silo trailer S is elevated with respect to rear steered silo trailer wheel set W; the process by which this elevation occurs will be more apparent when referring to FIGS. 5A–5F.

Between silo trailer S and compulsory mixer C there is provided dust hood H. The dust hood H is a part of the silo lifting structure. Dust within hood H is evacuated by vertical plenum to dust collector. This feature will be discussed in detail when silo trailer S is hereafter fully explained.

Hood H defines aggregate aperture 18 open to receive aggregate from aggregate trailer A as conveyed by aggregate transport conveyor 20. This opening for the conveyed aggregates is located in the dust hood on the side opposite the cantilever lifting structure.

Aggregate trailer A includes sand bin 22, fine aggregate bin 24, and course aggregate bin 26. Underlying each of these bins are respective weigh conveyors 23, 25, and 27. These weigh conveyors 23, 25, and 27 receive from each bin weight measured charges of aggregate, discharge to aggregate collection conveyor 20 and the aggregate collection conveyor 20 discharges on to a aggregate elevating conveyor. This aggregate elevating conveyor elevates and causes aggregates to be appropriately batched into compulsory mixer C. As can be seen, because of the high volume flow of concrete, up to two loaders L service the respective bins with required aggregate. Ramps are required on either side of the aggregate trailer so the loaders L can reach the center of the bins. Ramp bulkheads 11 are provided on either side of the aggregate trailer to facilitate building a loader ramp quickly.

Completing the assembled concrete plant P is control trailer 30 having control booth 32 and concrete liquid additive storage 34 with power plant 36. (See FIG. 4B) Further, and as is conventional with cement silo concrete plants, a series of cement and cement additive hauling guppy trailers G are used. As is well known in the art, conduits connecting the silo to the cement and cement additive hauling guppy trailers G are required. These connections are not shown in the interest of simplifying the important elements of this disclosure. Furthermore, the power plant 36 is of adequate size so that it can supply the power required to run the hauling guppies G. The control trailer 30 is arranged with conventional disconnect boxes (also not shown) where the power cords from the hauling guppies can be connected to the control trailer power distribution panel.

Plant operation is believed apparent to those having skill in the art. While operation of silo trailer S and dust collection system D is novel and will be set forth in detail hereafter, the gross operation of the plant can be set forth. Specifically, compulsory mixer C has a twelve cubic yard capacity (vibrated and compacted concrete).—As has been noted, compulsory mixer C may even have the capacity to uniformly mix up to a maximum of 13 cyd) with an actual enclosed volume sufficient to accommodate eighteen yards. Batching of cement, cement additives, water, and aggregate into the mixer can occur in less than 30 seconds. Thereafter, actual mixing operation of compulsory mixer C occurs for a period from 30 to 60 seconds starting from when the last rock enters the mixer and the first mixed concrete leaves the mixer. Compulsory mixer C bottom dumps mixed concrete to the concrete elevating belt B that in turn elevates and discharges concrete to receiving twelve yard (more or less) dump trucks R in under 21 seconds. Given the 900 barrel capacity of silo trailer S in cement and cement additives, the size of the aggregate weighing belts and the efficiency of the mixer, overall plant capacity up to 600 cubic yards per hour can be attained depending on the mixing time required by specification or to reach acceptable uniformity. Dependent upon job specifications, applicable regulations, job requirements including batch sizes, slower output rates may be required.

Having set forth overall operation of assembled concrete plant P, the transport disposition of this plant will be set forth. Thereafter, erection of assembled concrete plant P will be discussed. Finally, attention will be directed to silo trailer S as erected illustrating first dust collection system D operation and second weigh batching of the cement and cement additives.

Figure 2:
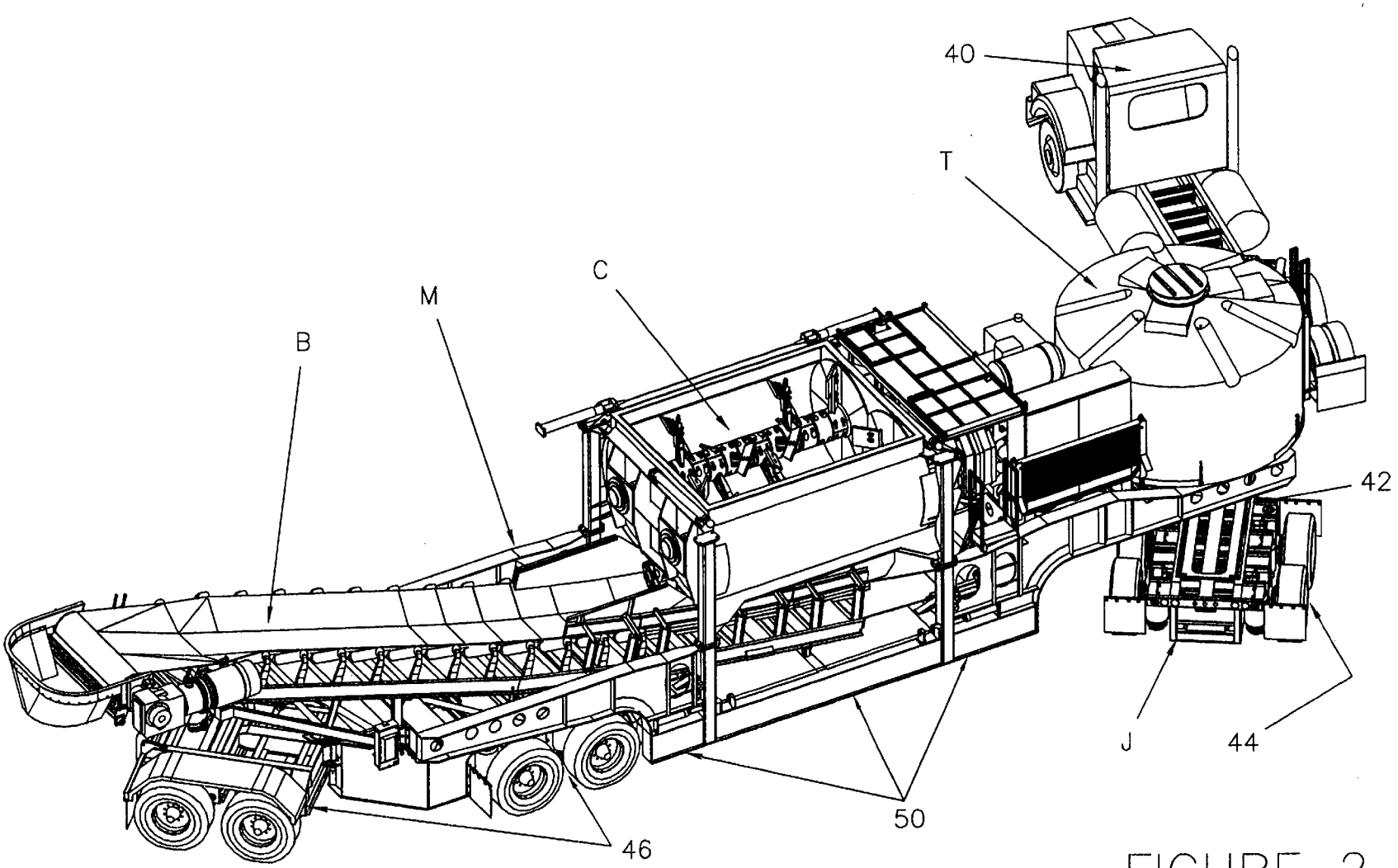
FIG. 2 illustrates the mixer trailer under transport.

FIG. 2 illustrates mixer trailer M under transport by tractor 40 at fifth wheel 42. Because of the weight of compulsory mixer C, and the other items on the trailer, jeep J distributes the load of compulsory mixer C between fifth wheel 42 and rear jeep/tandem axles 44. Four tandem axles 46 are included in the major transporting elements of mixer trailer M.

In the assembly of plant P, mixer trailer M is the first unit in place. As such, it is lowered at pad 50 directly onto (usually prepared) solid ground. For example, such prepared solid ground can include compacted aggregate base over well-drained soil. Lowering the trailer occurs by deflation of conventional air bags, not shown, between the respective rear jeep axles 44 and four tandem axles 46. In less than ideal soil, seismic or wind conditions, as an option, the mixer trailer can be supplied with outriggers 51 to increase the lateral stability of the mixer trailer with the silo erected.

Figure 3:
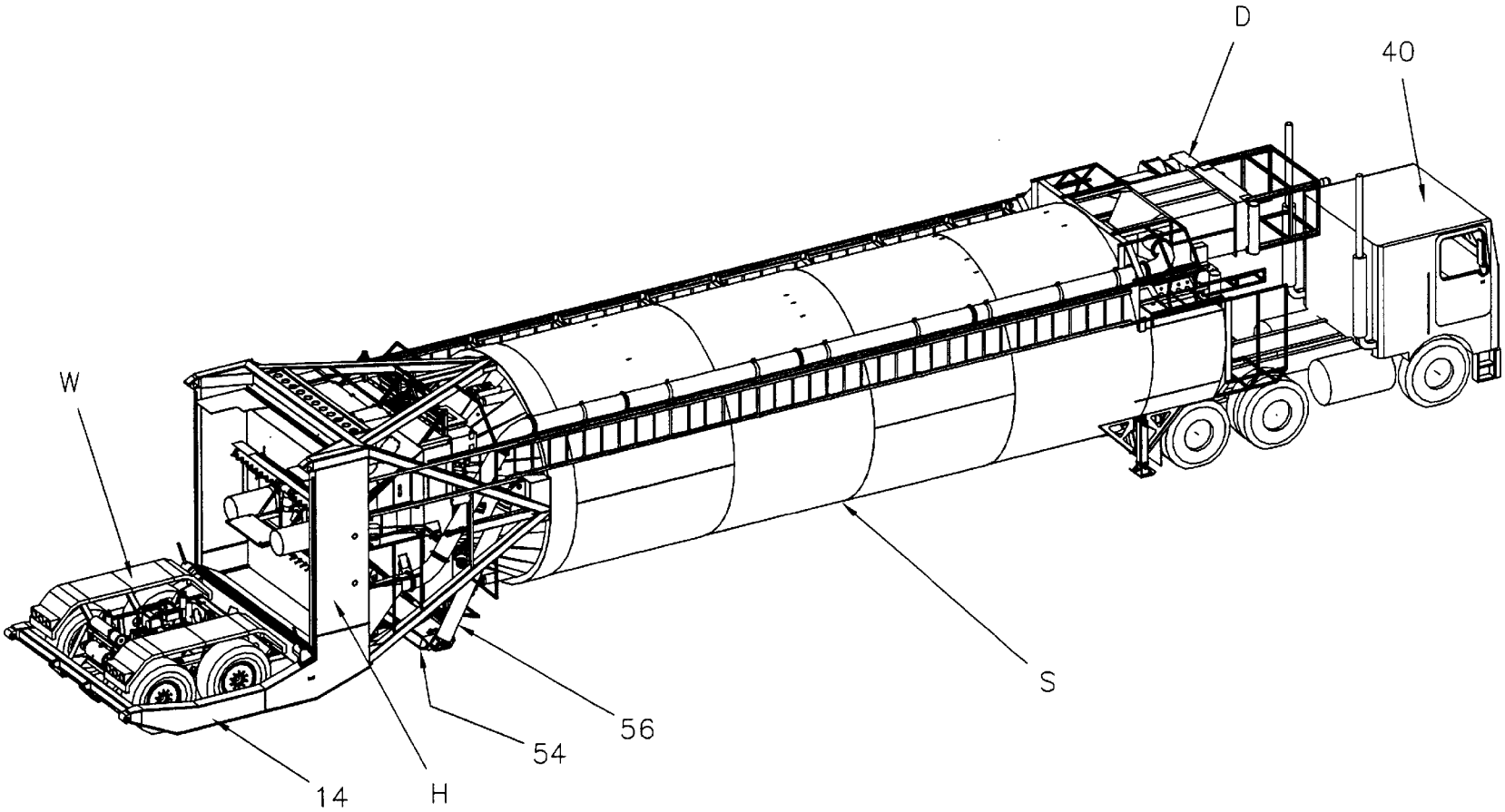
FIG. 3 illustrates the silo trailer under transport.

Silo trailer S is illustrated in FIG. 3. It includes dust hood H, rear steered silo trailer wheel set W, and cantilever beams 14. The dust hood is a structural part of the cantilever lifting beam structure. As can be seen, cantilever beams 14 are rigidly attached to silo trailer S and extend into distal relationship with rear steered silo trailer wheel set W at silo pivot point 50. As will be made clear hereafter, rear steered silo trailer wheel set W is backed to either side of compulsory mixer C at the mixer trailer and pinned into place. Hydraulic unit 52 actuates silo erecting pistons 56 to place erecting pad 54 on pad pivot arms 58 to cause self erection of silo trailer S on top of mixer trailer M.

Finally, and referring to FIG. 3, dust collection system D is shown at the "top" portion of silo trailer S adjacent tractor 40. It will be realized that by attaching dust collection system D and dust hood H to silo trailer S, we obviate the need for a separate dust collection trailer. Moreover, because the dust hood is an integral part of the silo trailer, we obviate the need to connect and disconnect the dust collection system during the erection or disassembly operation.

Referring to FIG. 4A and 4B, control trailer 30 only need be briefly addressed. It includes a conventional telescoping control booth 30, concrete liquid additive storage 34, power plant 36 and related accessories. Since this trailer is conventional, it will not be further discussed.

Figure 4C:
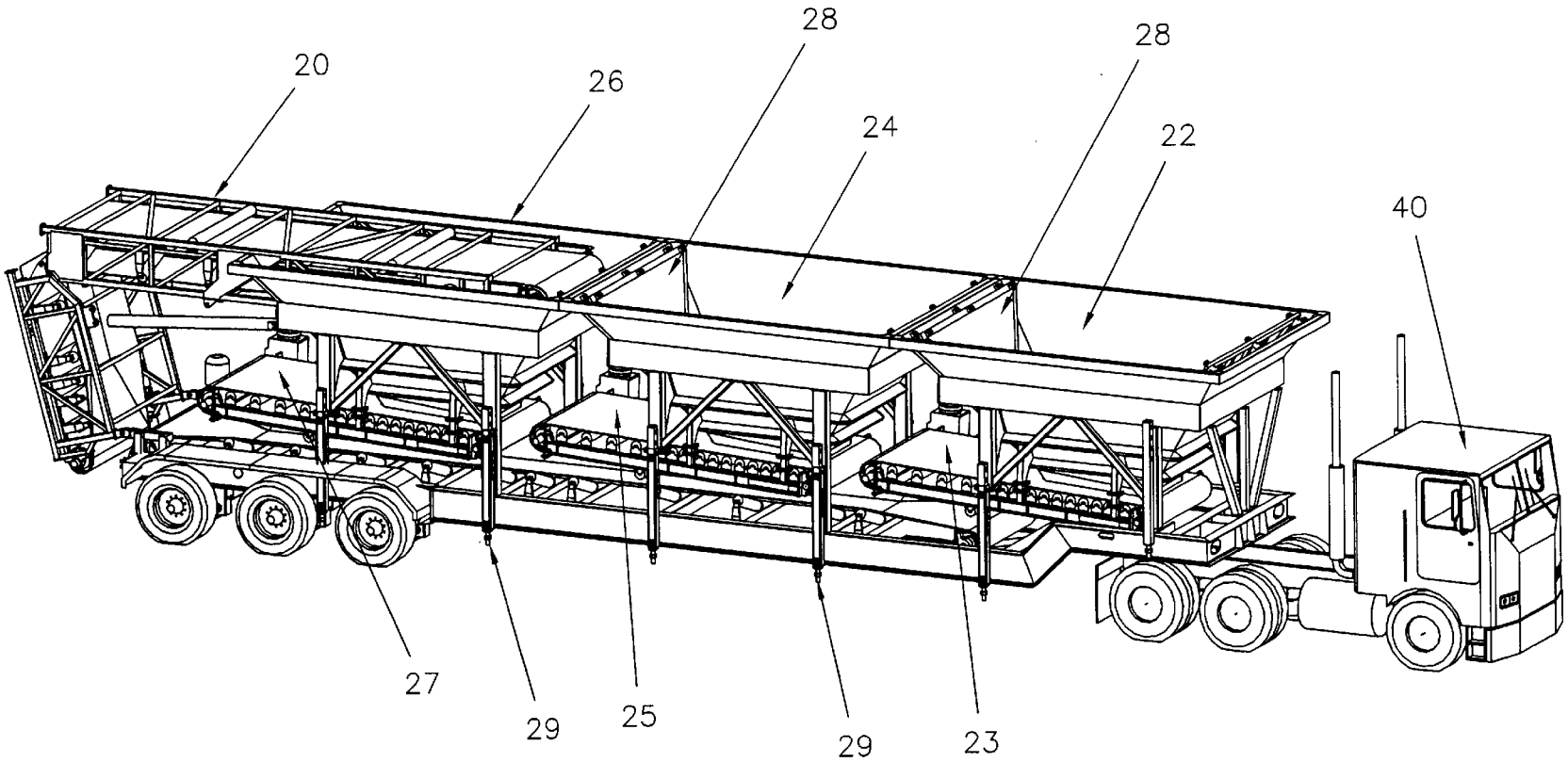
FIG. 4C and 4D illustrates the aggregate trailer under transport and in the erected state illustrating the aggregate elevating conveyor and the ramp bulkheads lowered into the working position with some of the ramp bulkheads removed for the sake of illustration to show the trailer telescopic support legs for leveling the trailer.
Figure 4D:
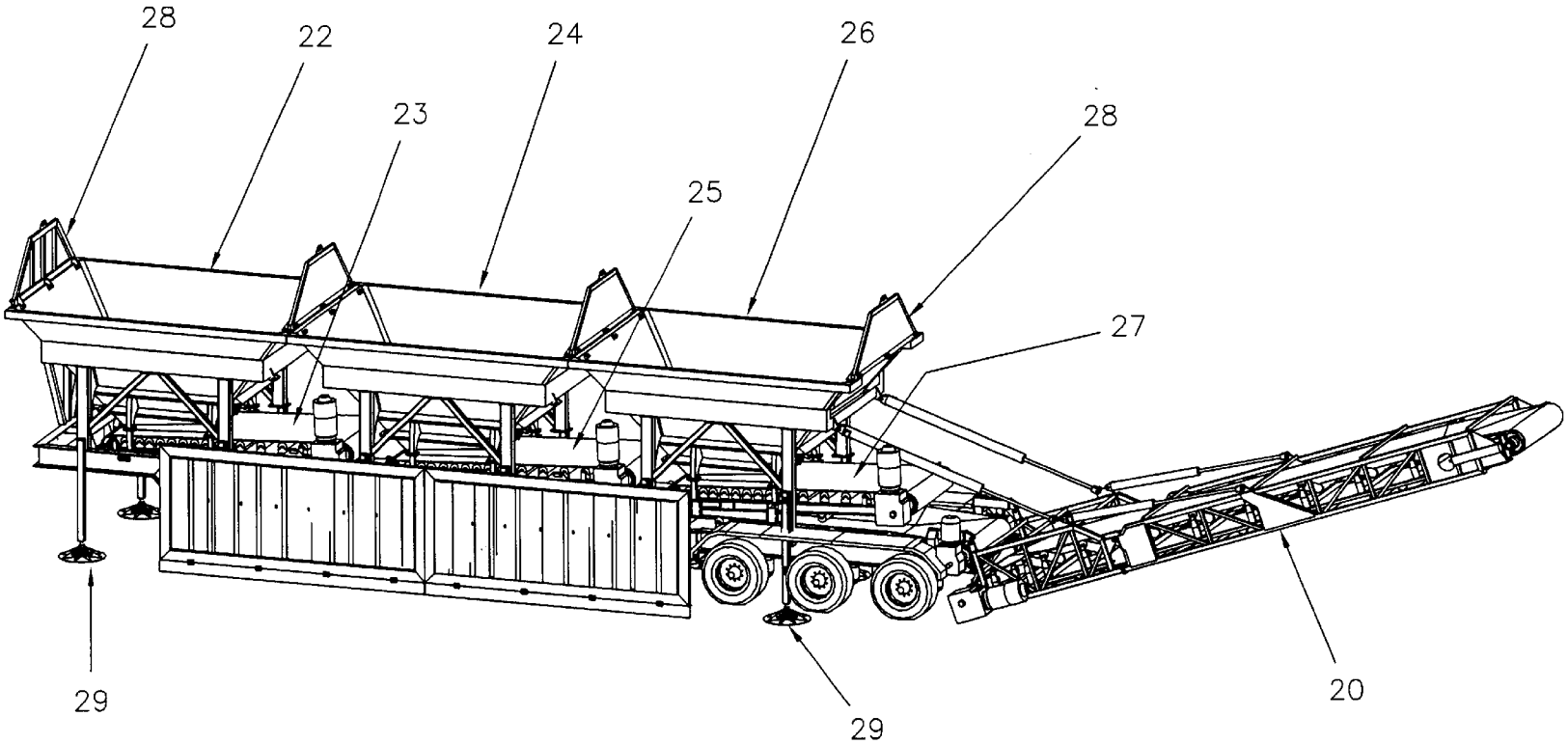

Referring to FIG. 4C and 4D, the aggregate trailer A is shown in the transport disposition. Its transport can be easily understood. Simply stated, aggregate elevating conveyor 20 is folded over the rear bin 22. The side of the bin is arranged to hinge out of the way to maintain the desired transport height. When the respective bins are empty, the illustrated wheel set enables normal transport. Before transporting, the aggregate trailer bulkheads 25 and bin 28 dividers must be hinged out of the way and the telescopic support tubes 29 manually retracted with the aid of hydraulic jacks. The aggregate trailer is illustrated in its working position in FIG. 4D. The construction of this aggregate trailer A is disclosed in our co-pending U.S. patent application Ser. No. 09/255,745 filed Feb. 23, 1999 entitled Portable and Modular Mixing and Batching Plant for Concrete by the inventors herein and is substantially identical with the exception that on this invention, the control booth is located on a separate trailer and the water tank is located on the mixer trailer. Accordingly, the disclosure of this application is incorporated hereto by reference as if fully set forth herein.

Figure 5A:
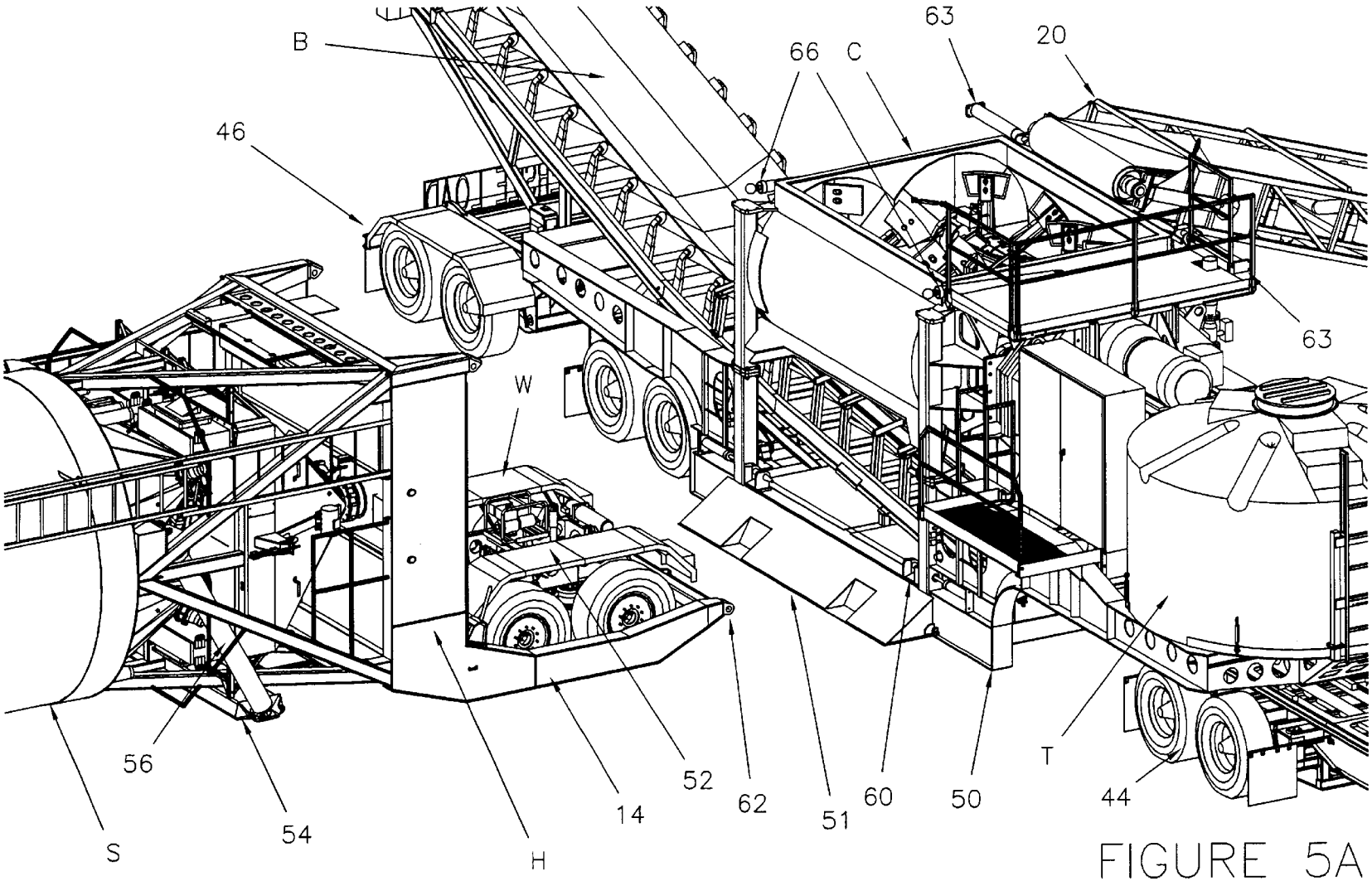

Referring to FIGS. 5A through 5F, the erection of assembled concrete plant P is sequentially illustrated. Referring to FIG. 5A, mixer trailer M has been placed. Compulsory mixer C with supporting trailer is shown resting on firm ground between rear jeep axles 44 and four tandem axles 46. Silo trailer S is shown being backed at rear steered silo trailer wheel set W into the spatial interval on mixer trailer M immediately below compulsory mixer C. Some observations can be made about silo trailer S in the vicinity of rear steered silo trailer wheel set W.

First, cantilever beams 14 extend through and to the trailing end of rear steered silo trailer wheel set W. Cantilever beams 14 pivot about this point during the erection process. Second, and during the backing process, cantilever beams 14 extend to female clevis 60 at male clevis 62. Since rear steered silo trailer wheel set W can minutely alter the steered course of silo trailer S, (radio) coordinated backing of silo trailer S can occur in an attempt to align the two trailers properly on the first try.

It will be understood that compulsory mixer C is by far the heaviest single item in the transported plant. Therefore, by resting mixer trailer M at mixer trailer pad 50, the assembled concrete plant P is provided with its foundation. To improve its lateral stability under certain site conditions, optional outriggers 51 can be provided.

Figure 5B:
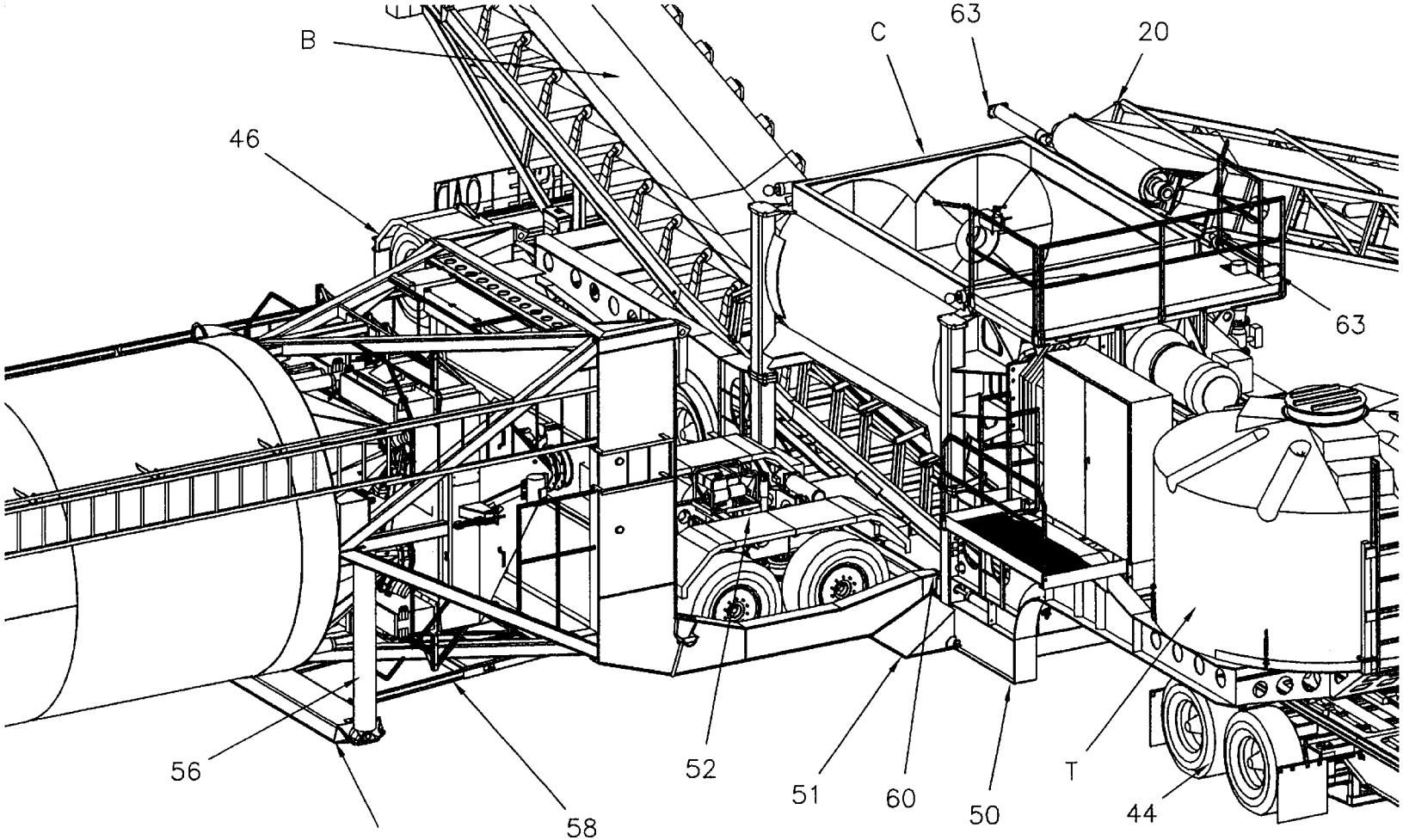

Referring to FIG. 5B, completed backing of silo trailer S into union with mixer trailer M has occurred. Female clevis 60 on mixer trailer M has mated to male clevis 62 on silo trailer S. In the interest of brevity, the mechanics of this pinned connection are not shown. Cantilever beams 14 can pivot silo trailer S from the illustrated horizontal transport disposition to a vertical erect disposition.

Before leaving FIG. 5B, an additional detail should be noted. Erecting/jacking pad 54 has been placed for erection. This has been done by telescopic expansion of pad pivot arms 58. This causes jacking pad 54 to swing from the transport position illustrated in FIG. 5A to the erecting position illustrated in FIG. 5B.

Figure 5C:
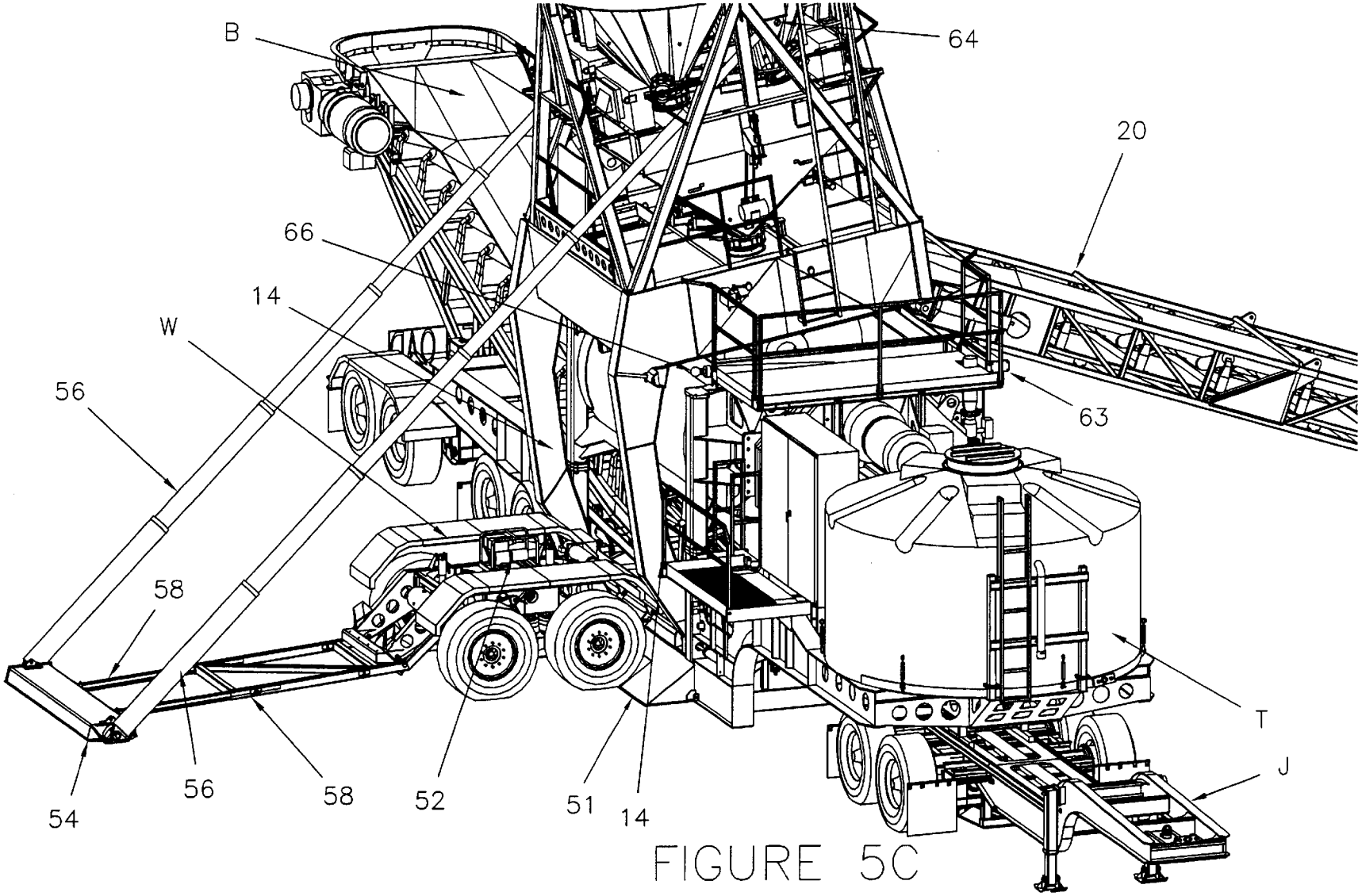

Referring to FIG. 5C, erection of silo trailer S is illustrated. Simply stated, silo hydraulic erecting pistons 56 expand between jacking pad 54 and silo pivot point connection 62.

It will be remembered that jacking pad 54 is constrained relative to rear steered silo trailer wheel set W. Specifically, pad pivot arms 58 connect the rear portion of rear steered silo trailer wheel set W to jacking pad 54. When pivoted against the weight of compulsory mixer C and mixer trailer M, erection of silo trailer S occurs.

FIG. 5C shows silo trailer S reaching top dead center on cantilever beams 14 overlying compulsory mixer C. If unrestrained pivot occurs from this top dead center position to a seated disposition of silo trailer S on compulsory mixer C, the momentum of silo trailer S generated in such seating could upset or damage silo trailer S. Further, it will be seen that there is nothing holding jacking pad 54 to the ground. In this disposition, jacking pad 54 would rapidly leave the ground following the momentum generated by settling of silo trailer S on compulsory mixer C.

Figure 5D:
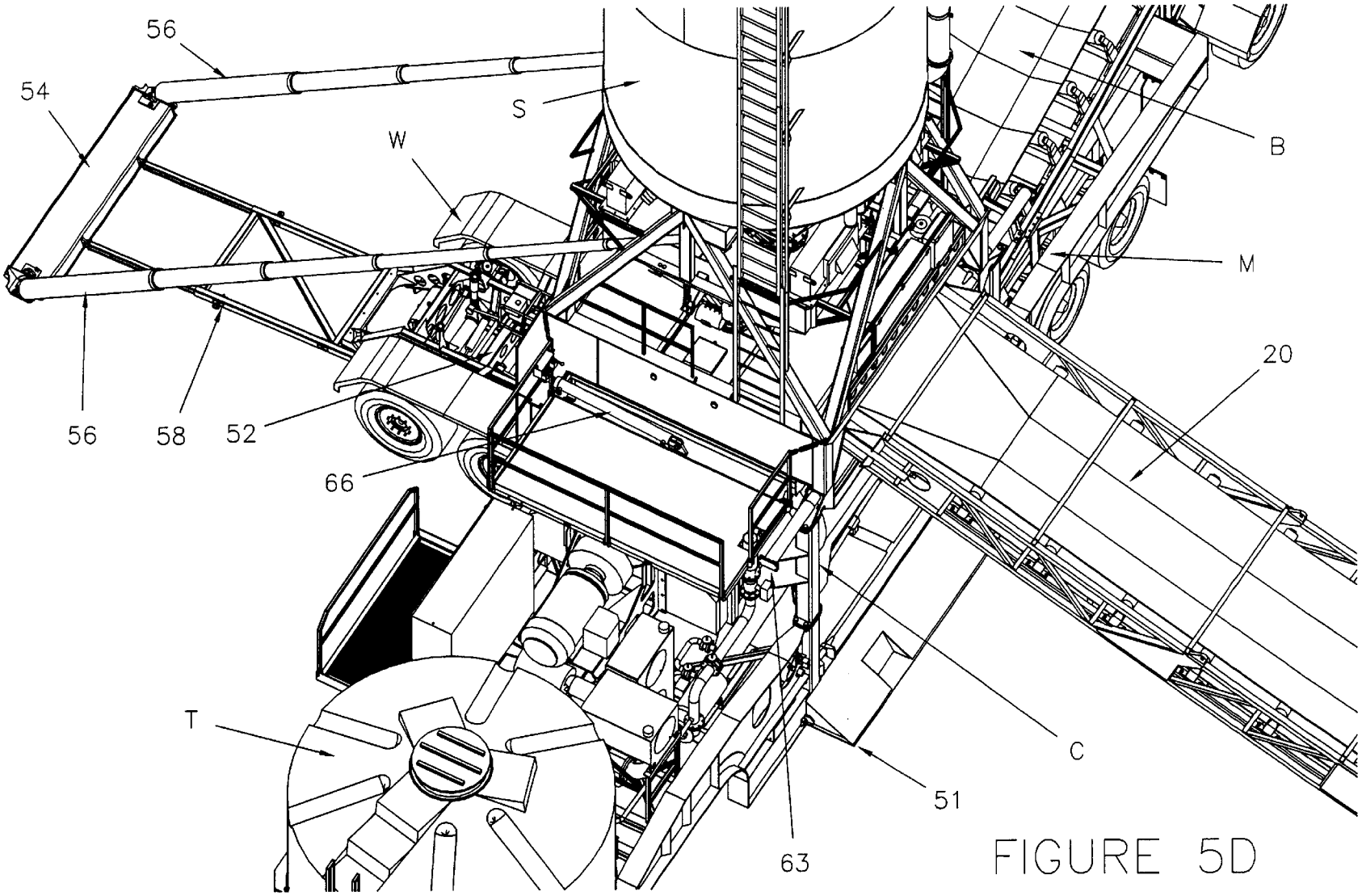

For this reason, opposition and damping cylinders 66 are provided between cantilever beams 14 and compulsory mixer C. These opposition and damping cylinders 66 contact cantilever beams 14 at the top dead center position and provide damped movement of silo trailer S as it comes to rest on compulsory mixer C of mixer trailer M. This position is illustrated in FIG. 5D. The opposition and damping cylinders 66 as well as the silo structural support beam with hydraulic pinning connectors 62, 64 can be disposed to the opposite side of the trailer if it is required that the silo be erected off the opposite side of the mixer trailer. The cushion cylinders 66 can be simply pivoted to the opposite side of the trailer while the silo structural support beam with hydraulic pin connectors (hidden from view) requires manual removal and lifting to the opposite side of the mixer then reconnection. Bolting connections are already provided for relocation on the opposite side of the mixer.

Figure 5E:
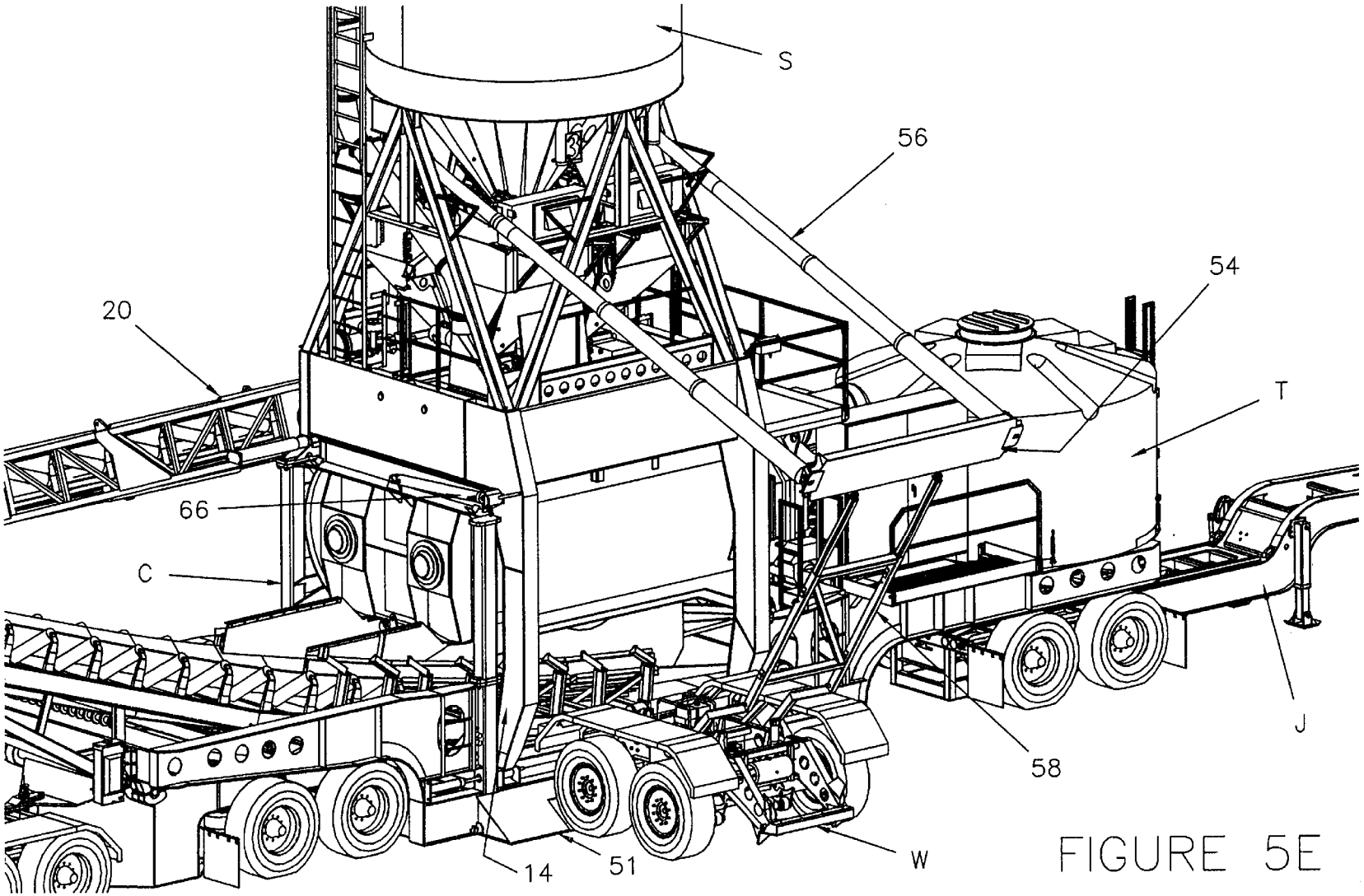

Briefly referring back to FIG. 1A and FIG. 1B, it will be understood that control trailer A is shown occupying the same footprint occupied by silo trailer S in FIGS. 5A and 5B during the silo erection process. This being the case, it is necessary to retract jacking pad 54 and its associated silo erecting pistons 56 and pad pivot arms 58. This process is shown in FIG. 5E. It should be noted that the control trailer would be equipped with electrical cords of sufficient length so the control trailer can be towed ahead out of the way of the silo if the silo requires lowering if high wind is forecasted.

Referring to FIG. 5E, silo erecting pistons 56 have been partially retracted. At the same time, pad pivot arms 58 have been telescoped to a fore-shortened disposition. Jacking pad 54 moves to a lowered location immediately above aggregate aperture 18 in dust hood H.

Figure 5F:
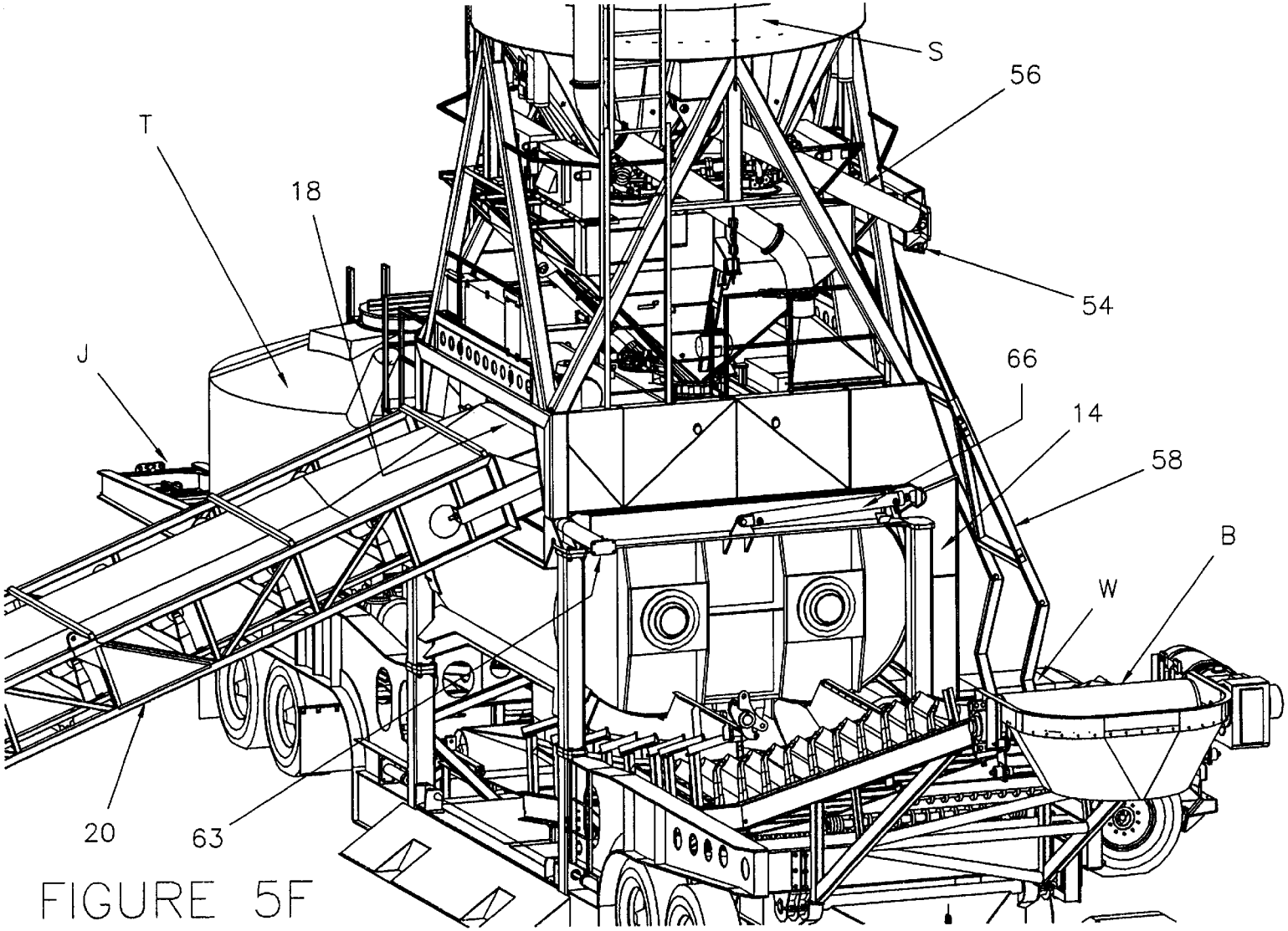

Finally, and in FIG. 5F, full retraction of jacking pad 54 is illustrated. In this disposition, aggregate trailer A is shown already in position along with its aggregate elevating conveyor 20 in respect to the aperture of the mixer dust hood. Lowering of aggregate elevating conveyor 20 and placement of the discharging elevated end of aggregate elevating conveyor 20 at aggregate aperture 18 in dust hood H has already occurred prior to the silo erection. Having described plant erection, plant disassembly for transport can be understood. It occurs in the reverse sequence proceeding from the disposition of FIG. 5F to the disposition illustrated in FIG. 5A.

Referring to FIGS. 6A through 6D, the specialized construction of silo trailer S can be set forth.

Figure 6A:
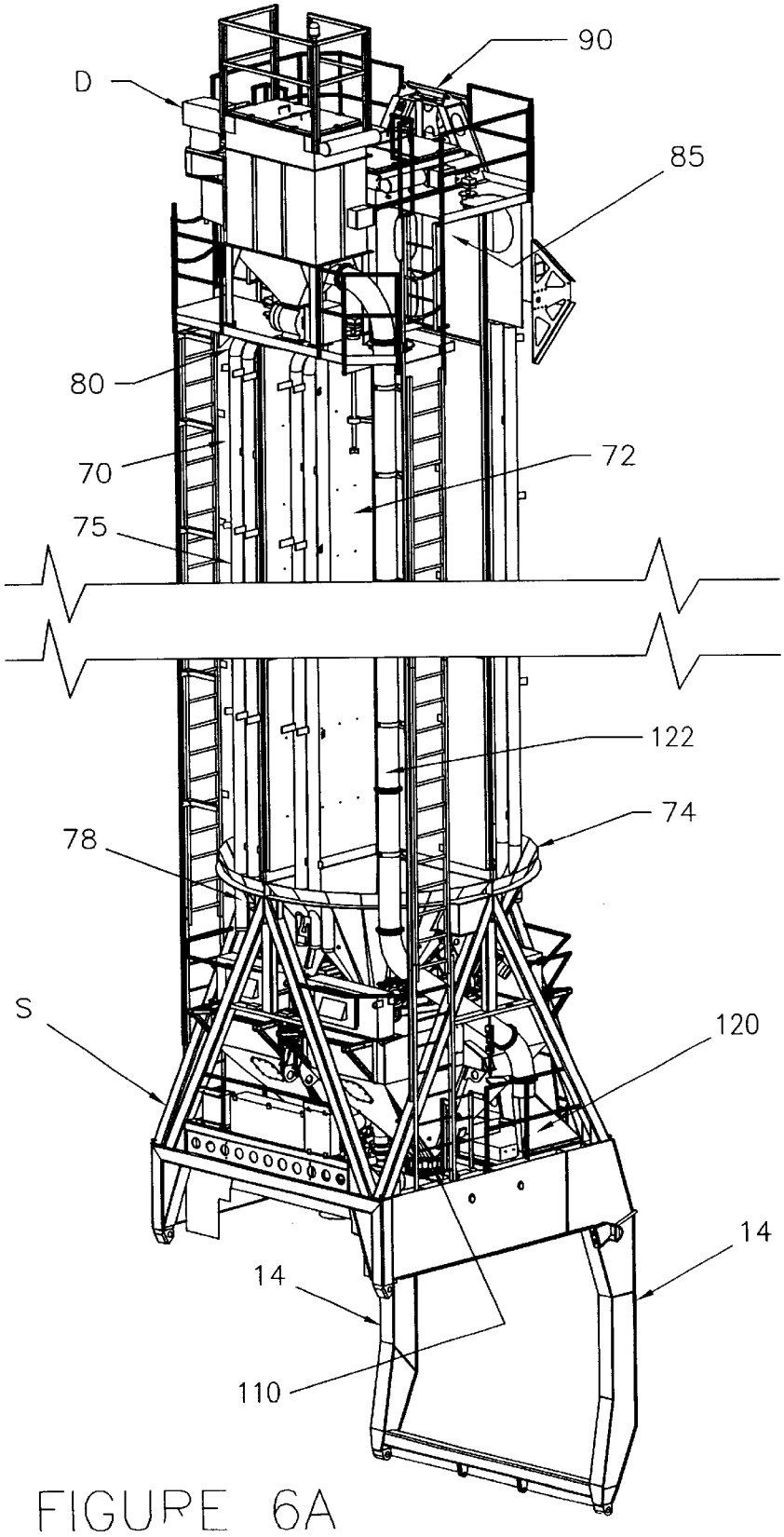
Figure 6B:
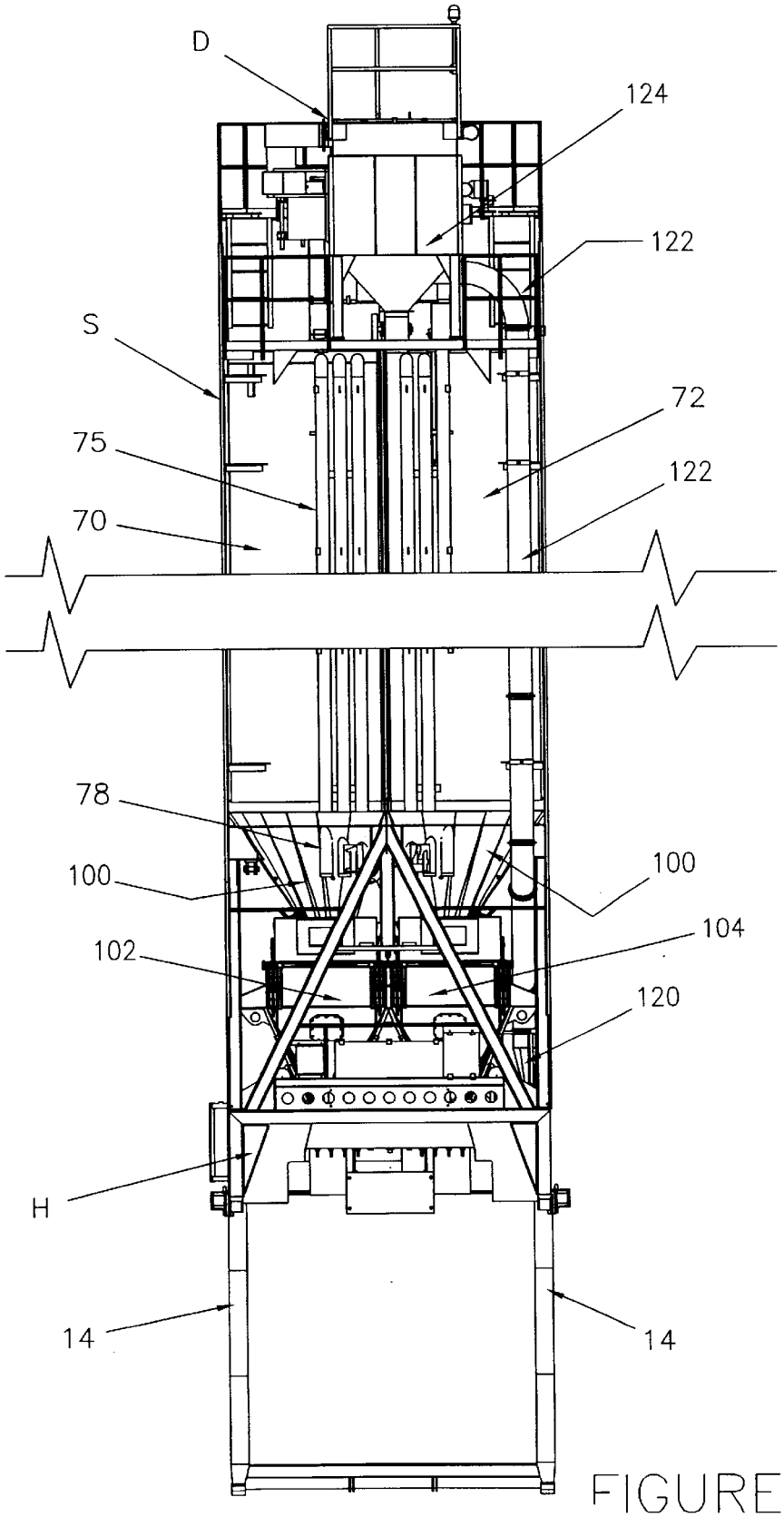
Figure 6C:
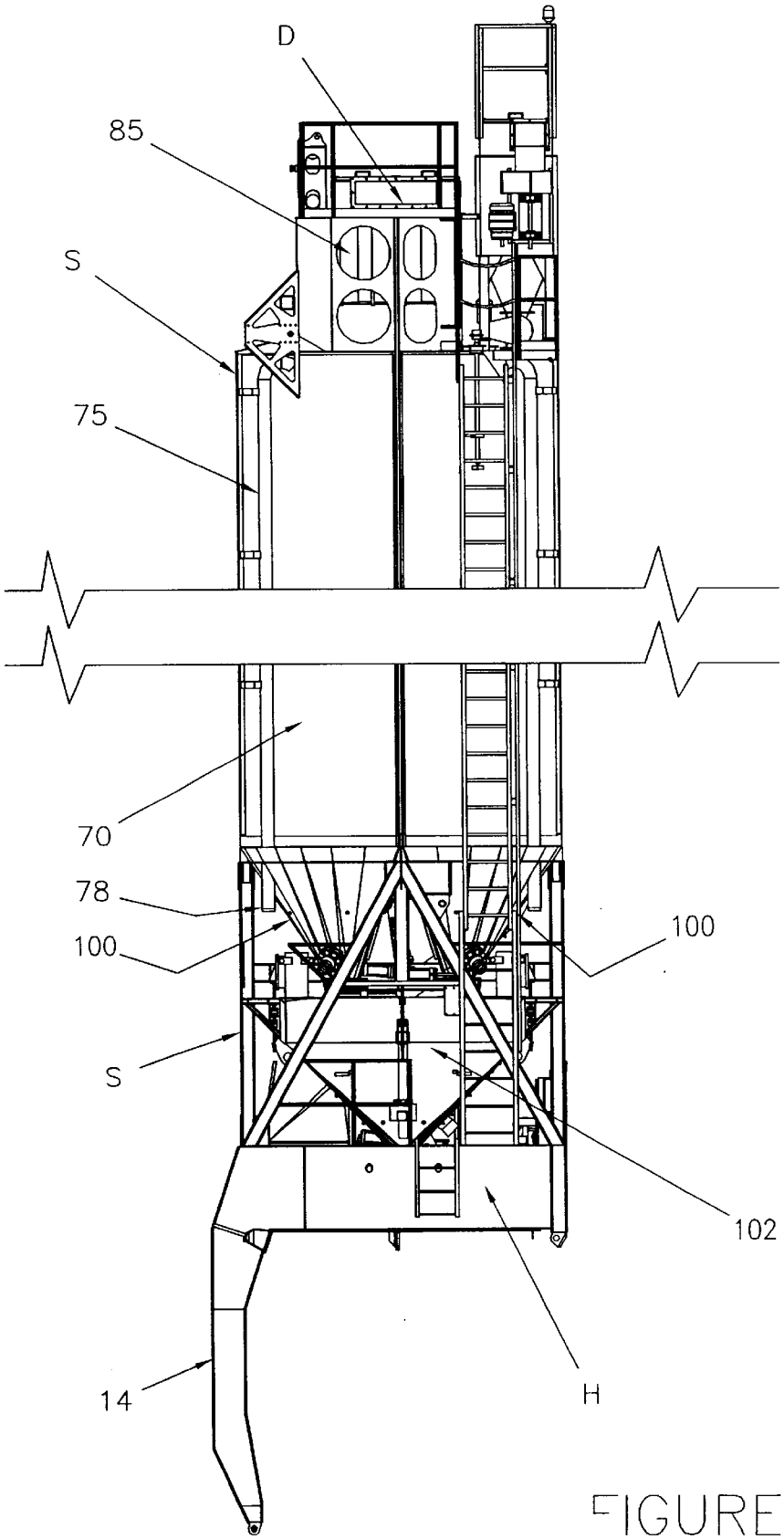

First, some comments upon the compartments of silo trailer S. Generally, silo trailer S has three vertical compartments. Referring to FIGS. 6A–6D, cement silo section 70, and fly ash silo section 72 are illustrated. Referring to FIG. 6B, fly ash silo section 72 and slag silo section 74 are illustrated. The slag and fly ash compartments can be used for all fly ash, all slag or all cement and any combination of this.

Secondly, a comment must be made about the overall 900 barrel capacity of silo trailer S. It will be remembered that silo trailer S is loaded from cement and cement additive hauling guppy trailers G by pneumatic conveyance through conduits (not shown). These conduits connect to silo fill pipes 75 at fill pipe connections 78 and pneumatically transport the air entrained cement and cement additives to fill pipe discharge 80 at the top of silo trailer S. When such discharge occurs, aeration of the cement and cement substitutes is a major concern. To this end, and as part of dust collection system D there is provided bag house (also know as a bin vent) 85 at the top of silo trailer S. This bag house 85 communicates with the top of cement silo section 70, fly ash silo section 72, and slag silo section 74. In practice, about 200 hundred barrels of cement, fly ash and slag will be settled. The remain 700 barrels of silo capacity will have cement, fly ash, and slag undergoing de-aeration, this de-aeration occurring under natural gravitational classification. Resultant dust will be collected at bag house 85 before atmospheric discharge. It will be noted that bag house 85 is a convenient point to attach fifth wheel connection 90 for hauling of silo trailer S.

This plant relies on the gravity discharge of the cement and cement additives. This reliance assures accurate and rapid measurement of cement and cement substitutes with the very few moving parts. Moreover, the cement and cement substitutes are required to be added in precise job specification percentile ranges. Further, and because of the relative high volume of the assembled concrete plant P, weighing of the respective batches must be simultaneous and not serial. Accordingly, cement silo section 70, fly ash silo section 72, and slag silo section 74 is provided with conventional butterfly valve and pant leg outlets 100 with aeration. Cement silo section 70 empties through two conventional butterfly valve and pant leg outlets 100 to cement weigh hopper 102. Likewise, fly ash silo section 72 empties through its own conventional butterfly valve and pant leg outlet 100 into fly ash and slag weigh hopper 104. It can be understood by the reader that by varying the open duty cycle of conventional butterfly valve and pant leg outlets 100 for fly ash silo section 72 and slag silo section 74, the percentage and amount of cement and cement substitutes can be precisely controlled.

Each of the cement weigh hopper 102 and fly ash and slag weigh hopper 104 is independently suspended on load cells. Thus, gravitational feed from silo trailer S and cement silo section 70, fly ash silo section 72, and slag silo section 74 occurs in parallel.

Each cement weigh hopper 102 and fly ash and slag weigh hopper 104 is again provided with bottom discharge butterfly valve 110. These respective bottom butterfly valves 110 empty into dust hood H and thence to compulsory mixer C. It will be understood that through the described gravitational feed, cement and cement substitutes can be rapidly dispensed without the need to rely on slower cumulative weighing of all the cementations materials into a single weigh hopper.

There remains to be explained the dust mitigation resulting from operation of assembled concrete plant P, especially at silo trailer S.

First, and regarding initial discharge from cement silo section 70, fly ash silo section 72, and slag silo section 74 into cement weigh hopper 102 and fly ash and slag weigh hopper 104, it will be understood that this path is contained. In viewing FIG. 6D, it will be understood that cement weigh hopper 102 is shown expanded outward from under cement silo section 70 and is not shown with connected filter 118. Further, fly ash and slag weigh hopper 104 is shown properly within and under fly ash silo section 72 and slag silo section 74 and is shown with connected filter 118 attached.

Operation of two connected filters 115 to each cement weigh hopper 102 and fly ash and slag weigh hopper 104 can now be explained. Simply stated, when cement weigh hopper 102 and fly ash and slag weigh hopper 104 are filled, air will be displaced by the cementatious material and dust will rise through breathing apertures 115 and be removed by the filters 118. Displaced air (without dust) only will be communicated to atmosphere. When cement weigh hopper 102 and fly ash and slag weigh hopper 104 are emptied, a vacuum is created. Outside air enters through the filters 118 and into the respective cement weigh hopper 102 and fly ash and slag weigh hopper 104 purging the filters of dust. Thus, it is seen that filters 115 form a simplified dust collection system.

Unfortunately, and because of the need to add aggregate, the removal of dust from under dust hood H is not as simple.

It will be remembered that dust hood H requires aggregate aperture 18 for the entry of aggregate. If dust hood H is not adequately ventilated under a negative pressure to a dust collection system, aggregate aperture 18 could be a substantial source of dust exhausting into the atmosphere. This evacuation of dust from the dust hood H under negative atmospheric pressure will now be explained.

Specifically, and referring to FIG. 6B, it will be seen that dust hood H is provided with dust collection plenum 120. Dust collection plenum 120 in turn communicates through vertical dust conduit 122 from dust collection plenum 120 to dust removal system 124 at dust collection system D on top of silo trailer S. This dust removal system 124 is convention with removal of the accumulated dust to the fly ash silo section 72.

It will be appreciated that vertical dust conduit 122 itself assists in the dust particle separation. Specifically, and due to the long vertical flow path against gravity, dust particles will settle against the airflow. Thus, at dust removal system 124 on removal of air entrained fines will occur.

Figure 7:
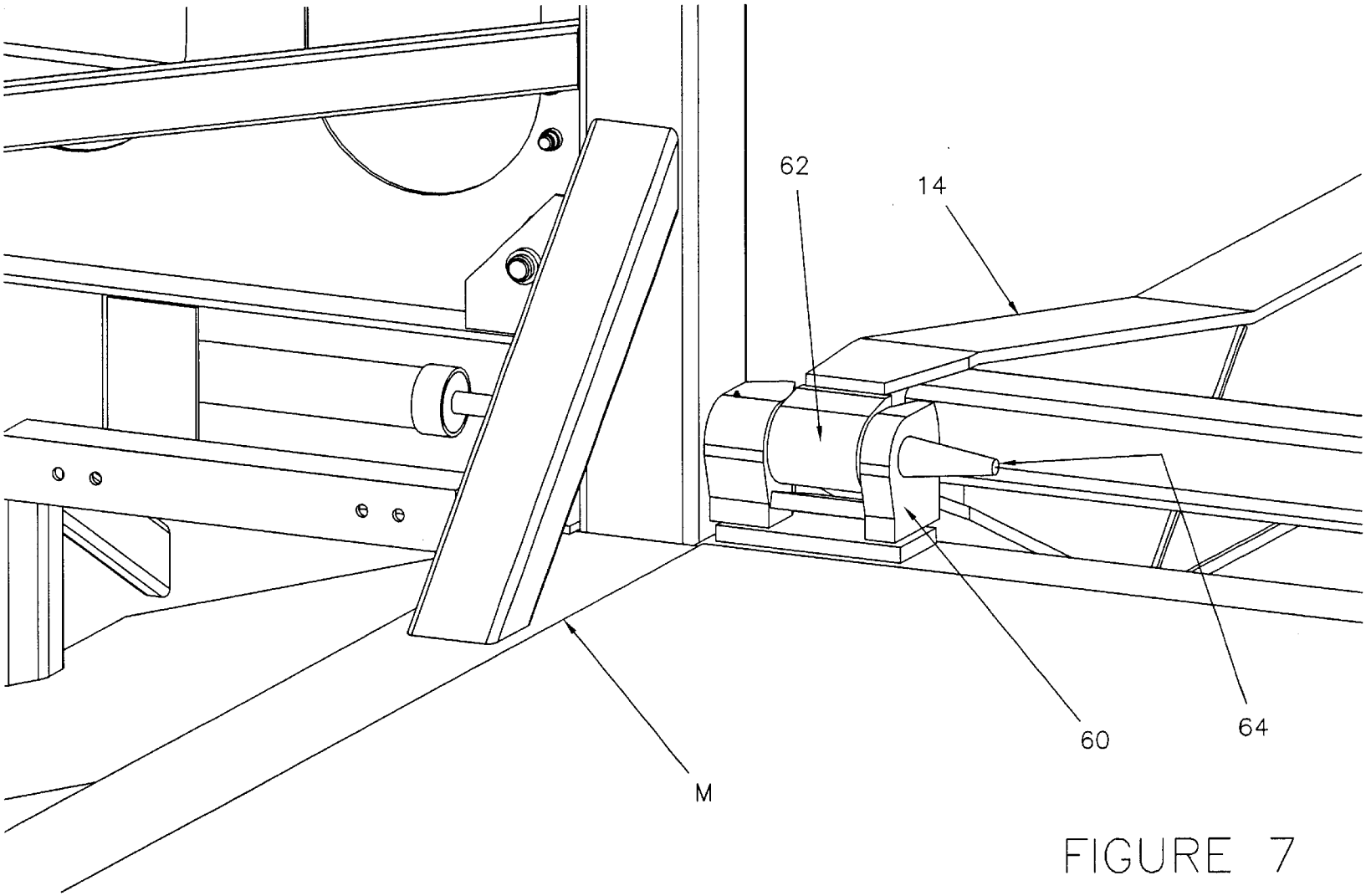
FIG. 7 is a detail of the pin mechanism for pivoting the silo with respect to the bottom of the compulsory mixer; and, FIG. 8 is detail of a locking mechanisms used on the silo for locking the weigh hoppers in place during silo transport.

Brief attention is directed to FIG. 7. In this view a typical silo pivot point connection 64 from mixer trailer M connects to female clevis 62 at the end of cantilever beam 14. It can be seen that silo pivot point connection 64 is actuated at a hydraulic cylinder for keying to female clevis 64. This typical detail is repeated on both sides of mixer M.

Figure 6D:
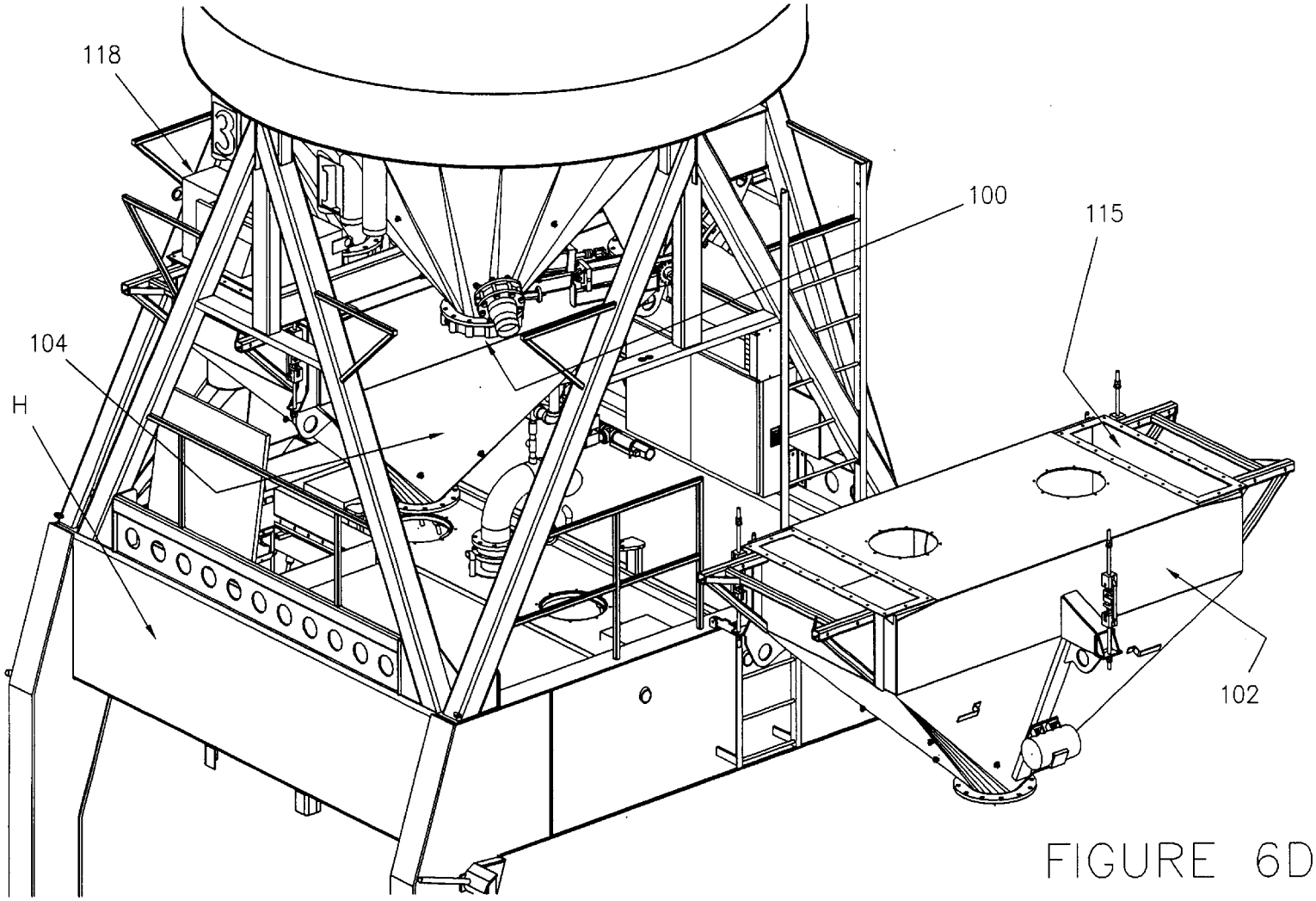
Figure 8:
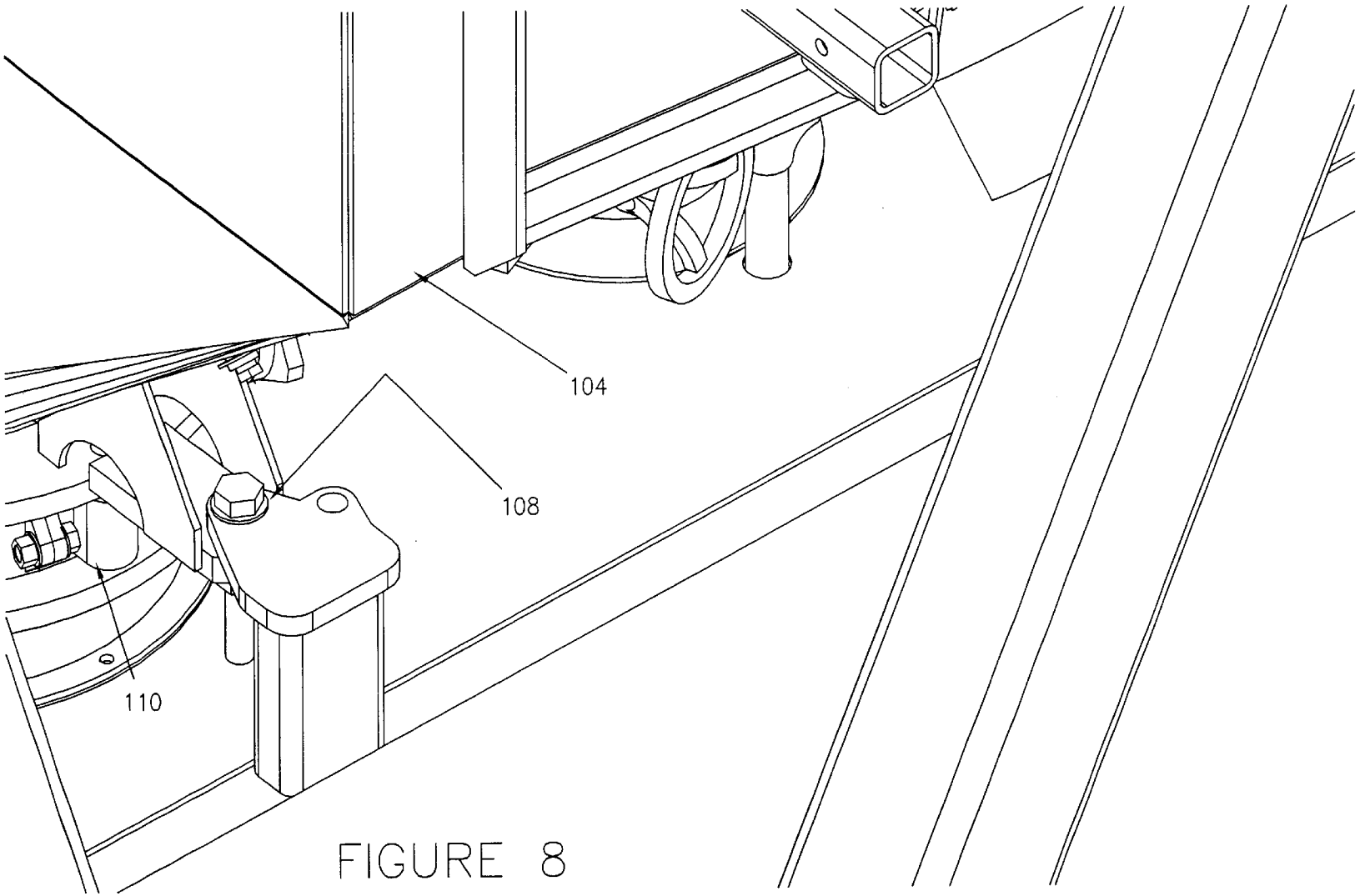

With further brief attention directed to FIG. 8, it will be remembered from FIG. 6D that weigh hoppers 102, 104 are independently suspended on load cells 110 (See FIGS. 6D and 8). During transport, it is necessary to clamp weigh hoppers 102, 104 so that damage to load cells 110 does not occur. This is done at bolt 108.

What is claimed is:

1. A process of erecting a high volume portable concrete plant on a plant site comprising the steps of:

providing a first trailer having a transporting wheel set at one end, a point for towing attachment at the other end, and supporting a compulsory mixer between the wheel set and point for towing attachment;

positioning the first trailer on the plant site to support the compulsory mixer on the plant site;

providing a second trailer having a transporting wheel set at one end, a point for towing attachment at the other end, and a cement silo supported in a horizontal transport position between the point for towing attachment and the wheel set;

providing a cantilever pivot for attachment to the cement silo at one end and pivotal attachment to the second trailer at the transporting wheel set to enable the cement silo to pivot from the horizontal transport position to an erect disposition overlying the compulsory mixer;

positioning the second trailer relative to the first trailer with the transporting wheel set adjacent the compulsory mixer; and, pivoting the cement silo relative to the compulsory mixer on the cantilever support from the horizontal transport disposition to the erected position overlying the compulsory mixer.

2. The process of erecting a high volume portable concrete plant on a plant site according to claim 1 where the positioning the first trailer on the plant site to support the compulsory mixer on the plant site includes:

the pivoting the cement silo relative to the compulsory mixer includes pivoting the second trailer from a horizontal disposition to a vertical disposition overlying the compulsory mixer.

3. The process of erecting a high volume portable concrete plant on a plant site according to claim 1 where the positioning the first trailer on the plant site to support the compulsory mixer on the plant site includes:

the provided a cantilever pivot is L-shaped cross-section including a first extremity of the L-shaped cross-section being fastened to the rear of the transporting wheel set and a second portion of the L-shaped cross-section extending across the bottom of the silo.

4. The process of erecting a high volume portable concrete plant on a plant site according to claim 1 where the positioning the first trailer on the plant site to support the compulsory mixer on the plant site includes:

providing pads at the bottom sides of the compulsory mixer for providing an extended width of the compulsory mixer to enable increased stabilization of the compulsory mixer and silo with respect to plant site.

5. The process of erecting a high volume portable concrete plant on a plant site according to claim 1 where the positioning the first trailer on the plant site to support the compulsory mixer on the plant site includes:

providing an aggregate supply having a aggregate transporting belt with a distal end for off loading aggregate to the compulsory mixer;

positioning the belt with the distal end overlying the compulsory mixer before the pivoting the cement silo relative to the compulsory mixer step whereby the silo when pivoting overlies both the compulsory mixer and the distal end of the aggregate transporting belt.

6. The process of erecting a high volume portable concrete plant on a plant site according to claim 5 where the positioning the first trailer on the plant site to support the compulsory mixer on the plant site includes:

the step of providing an aggregate supply includes providing an aggregate supply mounted to a third trailer.

7. The process of erecting a high volume portable concrete plant on a plant site according to claim 1 where the positioning the first trailer on the plant site to support the compulsory mixer on the plant site includes:

lowering the first trailer to support the compulsory mixer on the plant site.

8. A process of erecting a high volume portable concrete plant on a plant site according to claim 1 where the providing a cantilever pivot for attachment to the cement silo at one end includes permanently fastening the cantilever pivot to the cement silo.

9. A process of erecting a high volume portable concrete plant on a plant site according to claim 1 where the permanently fastening the cantilever pivot to the cement silo step includes permanently fastening the cantilever pivot between the cement silo and wheel set of the second trailer.

10. A process of erecting a high volume portable concrete plant on a plant site according to claim 1 where the positioning the second trailer relative to the first trailer includes:

positioning the second trailer to attach the cantilever pivot to the first trailer.

11. A process of erecting a high volume portable concrete batching and mixing plant on a plant site according to claim 1 and including the further steps of:

providing at least one expandable hydraulic cylinder attached to the silo at one end and extending to a point on the plant site away from the cantilever pivot at the other end; and, expanding the expandable hydraulic cylinder to pivot the silo on the cantilever support and move the cement silo between the horizontal transport disposition and the erect position overlying the compulsory mixer.

12. A process of erecting a high volume portable concrete plant on a plant site comprising the steps of:

providing a first trailer having a transporting wheel set at one end, a point for towing attachment at the other end, and supporting a compulsory mixer between the wheel set and point for towing attachment with one side of the compulsory mixer exposed to a side edge of the first trailer;

positioning the first trailer on the plant site to support the compulsory mixer on the plant site;

providing a second trailer having a steering transporting wheel set at one end, a point for towing attachment at the other end, and a cement silo supported in a horizontal transport position between the point for towing attachment and the wheel set;

providing a cantilever pivot for attachment to the cement silo at one end and pivotal attachment to the second trailer at the steering transporting wheel set to enable the cement silo to pivot from the horizontal transport position to an erect disposition overlying the compulsory mixer;

positioning the second trailer at the steering transporting wheel set adjacent the compulsory mixer at the one side of the compulsory mixer by backing and steering the steering transporting wheel set; and, pivoting the cement silo relative to the compulsory mixer on the cantilever support from the steering transporting wheel set of second trailer to move the silo from the horizontal transport disposition to the erected position overlying the compulsory mixer.

13. A process of erecting a high volume portable concrete plant on a plant site according to claim 12 comprising the steps of:

providing expanded pads at the side of the mixer trailer; and providing at least one indentation on at least one pad to enable the steering transporting wheel set to fit within the indentations of the expanded pads prior to pivoting the cement silo relative to the compulsory mixer.

14. A high volume portable concrete batching and mixing plant on a plant site comprising:

a first trailer having a transporting wheel set at one end, a point for towing attachment at the other end, and supporting a compulsory mixer between the wheel set and point for towing attachment, the first trailer including a water tank on one side of the compulsory mixer and an offloading conveyor on the opposite side of the compulsory mixer;

the offloading conveyor having a mixed concrete receiving end underlying the compulsory mixer for receiving mixed concrete from the compulsory mixer and extending outwardly and upwardly to a discharge end for discharging mixed concrete from an elevated position relative to the compulsory mixer;

the first trailer placed on the plant site to support the compulsory mixer on the plant site;

a second trailer having a transporting wheel set at one end, a point for towing attachment at the other end, and a cement silo supported in a horizontal transport position between the point for towing attachment and the wheel set;

the cement silo defining a hood for extending over the compulsory mixer, the hood enclosing a manifold for discharging water into the compulsory mixer;

a cantilever pivot for attachment to the cement silo at one end and pivotal attachment to the first trailer at the other end to enable the cement silo to pivot from the horizontal transport position adjacent the compulsory mixer to an erect disposition overlying the compulsory mixer;

the cantilever pivot attached between the cement silo and first trailer;

the cement silo and second trailer overlying and supported relative to the compulsory mixer; and, a connection between the water tank on the first trailer and the manifold in the hood on the second trailer for enabling water to be routed from the tank into the top of the compulsory mixer.

15. A high volume portable concrete plant on a plant site according to claim 14 comprising in further combination:

an aggregate trailer for receiving and conveying aggregate to the compulsory mixer on a conveyor;

the aggregate trailer juxtaposed to the compulsory mixer and silo to enter aggregate into the compulsory mixer.

16. A silo trailer for a high volume portable concrete batching and mixing plant on a plant site comprising:

a trailer having a transporting wheel set at one end, a point for towing attachment at the other end, and a cement silo supported in a horizontal transport position between the point for towing attachment and the wheel set;

a dust hood attached to the silo for confining dust from mixing at the compulsory mixer;

the cement silo defining a dust hood in a dust shielding relation at the bottom of the silo;

an aperture in the dust hood for the entry of aggregate to the compulsory mixer;

a dust collector mounted to the silo for drawing a vacuum to a dust collection site;

a vertical plenum connecting the interior of the dust hood and the dust collector for maintaining airflow from the aperture in the dust hood to the dust collector; and, a fifth wheel mounted adjacent the dust collector for enabling the silo trailer to be pulled.

17. A high volume portable concrete batching and mixing plant on a plant site comprising:

a first trailer having a transporting wheel set at one end, a point for towing attachment at the other end, and supporting a compulsory mixer between the wheel set and point for towing attachment;

the first trailer placed on the plant site to support the compulsory mixer on the plant site;

a second trailer having a transporting wheel set at one end, a point for towing attachment at the other end, and a cement silo supported in a horizontal transport position between the point for towing attachment and the wheel set;

a dust hood attached to the silo for confining dust from mixing at the compulsory mixer;

the cement silo and second trailer overlying and supported relative to the compulsory mixer to dispose the dust hood in a dust shielding relation overlying the compulsory mixer;

an aperture in the dust hood for the entry of aggregate to the compulsory mixer;

a dust collector mounted to the silo for drawing a vacuum to a dust collection site; and, a vertical plenum connecting the interior of the dust hood and the dust collector for maintaining airflow from the aperture in the dust hood to the dust collector.

18. A high volume portable concrete batching and mixing plant on a plant site according to claim 17 comprising:

the silo includes a plurality of separate compartments; and, the dust collector communicated to the compartments for drawing dust from the compartments.

19. A high volume portable concrete batching and mixing plant on a plant site according to claim 17 comprising:

the silo includes a plurality of separate compartments; and, a second dust collector is communicated to the compartments for drawing dust from the compartments.

* * * * *

UNITED STATES PATENT AND TRADEMARK OFFICE

CERTIFICATE OF CORRECTION

PATENT NO. : 6,293,689 B1
DATED : September 25, 2001
INVENTOR(S) : Ronald M. Guntert, Jr., William R. Cape; Christopher Cape; Roberto Salgarollo; Lowell B. Campbell It is certified that error appears in the above-identified patent and that said Letters Patent is hereby corrected as shown below:

Title page,
Item [75], please insert:
Ronald M. Guntert, Jr., Stockton, CA (US); William R. Cape; Christopher Cape, both of Racine, WI (US); Roberto Salgarollo, Herentals (BE); Lowell B. Campbell, Oakdale, CA (US); Gerald Lee Dahlinger, Ripon, CA (US).

Signed and Sealed this

Fifth Day of March, 2002

*Attest:*

*Attesting Officer*

JAMES E. ROGAN
*Director of the United States Patent and Trademark Office*